US008468930B1

(12) United States Patent
Bell

(10) Patent No.: US 8,468,930 B1
(45) Date of Patent: Jun. 25, 2013

(54) SCOPE ADJUSTMENT METHOD AND APPARATUS

(76) Inventor: John Curtis Bell, Koloa, HI (US)

( * ) Notice: Subject to any disclaimer, the term of this patent is extended or adjusted under 35 U.S.C. 154(b) by 293 days.

(21) Appl. No.: 12/607,822

(22) Filed: Oct. 28, 2009

Related U.S. Application Data

(63) Continuation-in-part of application No. 11/120,701, filed on May 3, 2005, now Pat. No. 7,624,528, which is a continuation-in-part of application No. 10/441,422, filed on May 19, 2003, now Pat. No. 6,886,287.

(60) Provisional application No. 60/381,922, filed on May 18, 2002.

(51) Int. Cl.
*F41G 3/08* (2006.01)
*F41G 3/06* (2006.01)

(52) U.S. Cl.
USPC ..... 89/204; 89/41.17; 89/41.06; 342/67

(58) Field of Classification Search
USPC ..... 89/204, 205, 41.17, 41.06; 342/67
See application file for complete search history.

(56) References Cited

U.S. PATENT DOCUMENTS 3,123,915 A 3/1964 Wilkinson
3,464,770 A 9/1969 Schmidt
3,506,330 A 4/1970 Allen
3,579,840 A 5/1971 Heinzel
3,634,940 A 1/1972 Vockenhuber
3,737,232 A 6/1973 Milburn, Jr.
3,766,656 A 10/1973 Westphal
3,782,822 A 1/1974 Spence
3,824,699 A 7/1974 Lenz et al.
3,845,276 A 10/1974 Kendy et al.
4,062,267 A 12/1977 Vinches et al.
4,108,551 A 8/1978 Weber
4,200,355 A 4/1980 Williams, Jr.
4,317,304 A 3/1982 Bass
4,375,725 A 3/1983 Orlob
4,497,548 A 2/1985 Burris
4,561,204 A 12/1985 Binion
4,777,352 A 10/1988 Moore
4,787,291 A 11/1988 Frohock, Jr.
4,787,739 A 11/1988 Gregory
4,993,833 A 2/1991 Lorey et al.
4,998,811 A 3/1991 Basta
5,005,308 A 4/1991 Parks
5,020,892 A 6/1991 Glover et al.
5,180,875 A 1/1993 Berry, Jr. et al.
5,181,323 A 1/1993 Cooper
5,194,908 A 3/1993 Lougheed et al.
5,355,609 A 10/1994 Schenke
5,374,986 A * 12/1994 Solinsky ..... 356/4.01
5,388,005 A 2/1995 Wilson
5,400,539 A 3/1995 Moore
5,491,546 A 2/1996 Wascher et al.

(Continued)

*Primary Examiner* — Stephen M Johnson
(74) *Attorney, Agent, or Firm* — Knobbe, Martens, Olson & Bear, LLP

(57) ABSTRACT

A rifle scope system allows adjustment of the point-of-aim of a scope while a shooter maintains the shooting posture and the scope sight picture. The scope system saves ballistic parameters and the associated point-of-aim information of a shot in a database of empirical data points. While the scope is aimed at a target, a processor may use the empirical data points along with the ballistic parameters of the target to determine point-of-aim adjustments of the scope. The adjustment system allows processor-determined adjustments to be effected in a quick manner.

21 Claims, 32 Drawing Sheets

U.S. PATENT DOCUMENTS 5,511,317 A 4/1996 Allen
5,513,440 A 5/1996 Murg
5,555,662 A 9/1996 Teetzel
5,584,137 A 12/1996 Teetzel
5,669,174 A 9/1997 Teetzel
5,680,725 A 10/1997 Bell
5,686,690 A * 11/1997 Lougheed et al. ..... 89/41.17
5,745,287 A 4/1998 Sauter
5,771,595 A 6/1998 Bell
5,771,623 A 6/1998 Pernstich et al.
5,822,905 A 10/1998 Teetzel
5,898,519 A 4/1999 Palmer
5,974,940 A 11/1999 Madni et al.
6,046,868 A 4/2000 Theriault et al.
6,111,692 A 8/2000 Sauter
6,199,286 B1 3/2001 Reed et al.
6,208,461 B1 3/2001 Gaber
6,252,706 B1 * 6/2001 Kaladgew ..... 359/399
6,260,466 B1 * 7/2001 Humphreys ..... 89/41.06
6,266,911 B1 7/2001 Suzuki
6,269,581 B1 8/2001 Groh
6,295,754 B1 10/2001 Otteman et al.
6,397,483 B1 6/2002 Perkins
6,449,419 B1 9/2002 Brough et al.
6,487,809 B1 12/2002 Gaber
6,519,083 B2 2/2003 Heinrich
6,563,636 B1 5/2003 Baun et al.
6,603,602 B1 8/2003 McWilliams
6,679,609 B2 1/2004 Ohtomo et al.
6,705,037 B2 3/2004 Van Kirk
6,813,025 B2 11/2004 Edwards
6,886,287 B1 5/2005 Bell et al.
7,350,329 B1 4/2008 Bell et al.
7,624,528 B1 12/2009 Bell et al.
2002/0051288 A1 5/2002 Shirai et al.
2004/0020099 A1 * 2/2004 Osborn, II ..... 42/122
2005/0213962 A1 9/2005 Gordon

* cited by examiner

594A

| | 694A X Offset | 694B Y Offset | 694C Range | 694D Wind | 694E Bullet Data | 694F Atmosphere | 694G Slope | 694H Altitude |
|---|---|---|---|---|---|---|---|---|
| 696A | + 1 MOA | − 2 MOA | 321 meters | X= − 5 mph<br>Y= 0 mph<br>Z = 1 mph | 120 grains projectile<br>120 grains load | 42% humidity<br>29.84 in (N/Amb)<br>78°F | 8° | 1,122 feet |
| 696B | 0 MOA | + 1 MOA | 100 meters | X= 1 mph<br>Y= 1 mph<br>Z = 0 mph | 120 grains projectile<br>120 grains load | 61% humidity<br>29.62 in<br>65°F | 5° | 2,486 feet |
| 696C | − 2 MOA | − 4 MOA | 448 meters | X= 10 mph<br>Y= 2 mph<br>Z = .5 mph | 120 grains projectile<br>120 grains load | 22% humidity<br>30.87 in<br>81°F | 2° | 481 feet |
| 696D | 3 MOA | − 0.5 MOA | 250 meters | X= 15 mph<br>Y= 4 mph<br>Z = 0 mph | 120 grains projectile<br>120 grains load | 57% humidity<br>30.1 in<br>50°F | −7° | 5,629 feet |
| | ... | ... | ... | ... | ... | ... | ... | ... |

FIG. 14D

SCOPE ADJUSTMENT METHOD AND APPARATUS

RELATED APPLICATIONS

This application is a continuation-in-part of U.S. patent application Ser. No. 11/120,701, filed on May 3, 2005, now U.S. Pat. No. 7,624,528, entitled "SCOPE ADJUSTMENT METHOD AND APPARATUS", which is a continuation-in-part of U.S. patent application Ser. No. 10/441,422, filed on May 19, 2003, now U.S. Pat. No. 6,886,287, entitled "SCOPE ADJUSTMENT METHOD AND APPARATUS," which claims priority from U.S. provisional application Ser. No. 60/381,922, filed on May 18, 2002.

BACKGROUND

1. Field of the Disclosure

The present teachings generally relate to systems and methods for optical sighting of firearms and, in various embodiments, to a system and method for adjusting a point of aim of a rifle scope without having to significantly disturb the shooter's scope sight picture and the shooting posture.

2. Description of the Related Art

Many firearms such as rifles are equipped with optical scopes to aid in accurate positioning of the firearm's point of aim (POA). When shot, a bullet's point of impact (POI) at a target varies depending on various ballistic parameters associated with the bullet and the shooting environment. Some of the common ballistic parameters include, for example, the bullet type, distance to the target, and wind speed.

In order to place the bullet where the rifle is aimed at, the POA needs to coincide sufficiently close to the POI. If it is not, the POA needs to be "sighted in" such that the POA is moved towards the POI. Typically, a shooter "zeroes" the POA such that the POA coincides with the POI at a given distance. The shooter then relies on a ballistic table or prior experience to estimate either a rise or drop of the bullet at other varying distances.

Such sighting-in methods and procedures typically involves repetition of shots with manual manipulations of the elevation and/or windage adjustment mechanisms. Each manipulation of the scope adjustment usually requires the shooter to disturb the scope sight picture. After each adjustment is made, the shooter has to re-assume the proper shooting posture and re-acquire the target through the scope. Furthermore, subsequent shots at targets at non-zeroed distances may be subject to shooter's estimate errors.

The continuous repetition of this process results in potential errors in the sighting in of the firearm. Specifically, with higher power firearms, the recoil of the firearm can be substantial. As such, a shooter who is repeatedly firing the firearm to sight it in may begin to flinch prior to firing the rifle in anticipation of the recoil. Flinching can then result in the shooter introducing error into the shooting process thereby increasing the difficulty in sighting in the firearm. Flinching is generally observed to increase with each additional shot fired. Hence, there is a need for a system and process that allows the firearm to be sighted-in in a more efficient fashion.

A further difficulty with firearms is that the shooter must often have to estimate the deviation between the point of aim and the point of impact due to distance. As discussed above, most shooters sight the firearm such that the point of aim and point of impact coincide at a given distance. However, when shooting at a distance other than the given distance, the shooter must estimate the range and then estimate the change in bullet drop due to the range. Naturally, estimating the range can be very difficult, particularly when it must be done very quickly as is common in hunting or combat situations. Hence, there is further a need for a system that allows the shooter to more easily shoot at targets at ranges varying other than the sighted in range.

Thus, there is an ongoing need to improve the manner in which rifle scopes are adjusted. There is a need for a scope adjustment system and method that allows a shooter to place the bullet at the desired target location in an improved manner. There is also a need for system and method that facilitates target range determination and improved use of such information in shooting application.

SUMMARY

In one embodiment, a sight system for a projectile weapon comprises a ballistic parameter detector that measures one or more parameters that affect the ballistic flight of a projectile fired by the weapon, an adjustable aiming device that defines a point of aim of the device, wherein the point of aim can be adjusted so that the point of aim coincides with the point of impact for a projectile fired by the weapon for a given set of parameters measured by the ballistic parameter detector, a memory wherein empirical point of aim adjustment data and correlated empirical ballistic parameters are stored, wherein the stored aim adjustment data and correlated ballistic parameters comprise data capture for successive firings of projectiles from the weapon, and a processor that, upon receiving new sensed ballistic parameters from the ballistic parameter detector, determines new aim adjustment data based at least in part upon the stored empirical point of aim adjustment data and correlated empirical ballistic parameters and provides the new aim adjustment data to the adjustable aiming device to adjust the point of aim for the new sensed ballistic parameters.

In one embodiment, a sight system for a firearm comprises an optical assembly having a point of aim indicator, wherein the point of aim indicator is configured to be movable relative to an optical axis of the optical assembly, an adjustment mechanism coupled to the point of aim indicator and configured to adjust the point of aim indicator relative to the optical axis, a ballistic parameter detector configured to detect one or more current ballistic parameters, and a memory. The sight system further comprises a processor configured to initiate storage in the memory of an empirical zero data point indicating a first position of the point of aim indicator and one or more first ballistic parameters associated with the first position, initiate storage in the memory of one or more empirical secondary data points, wherein each secondary data point indicates a secondary position of the point of aim indicator and one or more secondary ballistic parameters associated with the respective secondary position, receive one or more current ballistic parameters associated with a target, determine a point of aim adjustment increment between a current position of the point of aim indicator and an adjusted position of the point of aim indicator based on the zero data point, the one or more secondary data points, and the one or more current ballistic parameters, and signal the adjustment mechanism to adjust the position of the point of aim indicator according to the determined point of aim adjustment increment.

In one embodiment, a method for adjusting a point of aim of an optical assembly configured to be attached to a firearm comprises storing a first data point indicating a first position of a point of aim indicator of an optical assembly and first one or more ballistic parameters associated with the first position of the point of aim indicator in a computer memory, wherein the first position of the point of aim indicator indicates a point of aim that coincides with a first point of impact of a projectile fired by a firearm subject to the first one or more ballistic parameters, and storing one or more secondary data point indicating a respective secondary position of the point of aim indicator and secondary one or more ballistic parameters associated with the secondary position of the point of aim indicator in a computer memory, wherein the secondary position of the point of aim indicator indicates a point of aim that coincides with a point of impact of a projectile filed by the firearm subject to the respective secondary one or more ballistic parameters. The method further comprises receiving one or more target ballistic parameters from one or more sensor devices, determining with a computing device an adjusted position of the point of aim indicator based on the one or more target ballistic parameters, the first data, and the second data, and initiating adjustment by an actuator device of the point of aim indicator to the adjusted position.

BRIEF DESCRIPTION OF THE DRAWINGS

FIG. 14D illustrates one embodiment of a record 594A of a plurality of empirical data points;

DETAILED DESCRIPTION OF CERTAIN EMBODIMENTS

Figure 1:
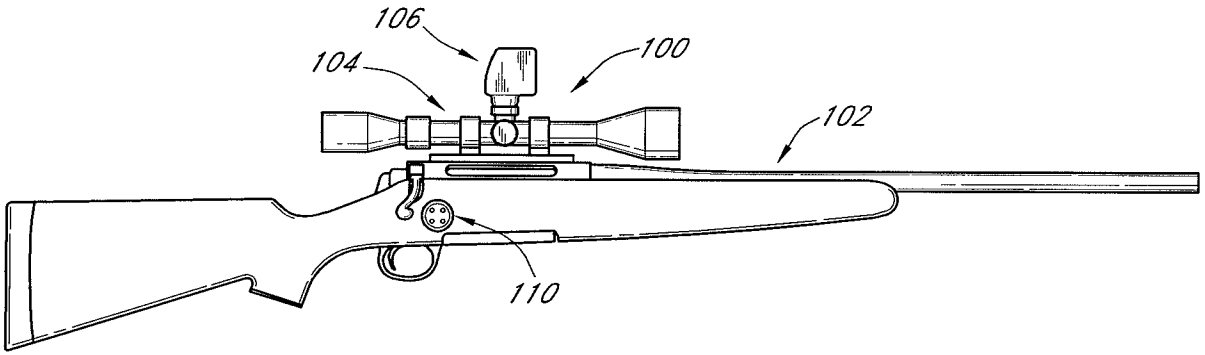
FIG. 1 illustrates one embodiment of a scope adjustment system mounted on an exemplary bolt action rifle.

These and other aspects, advantages, and novel features of the present teachings will become apparent upon reading the following detailed description and upon reference to the accompanying drawings. In the drawings, similar elements have similar reference numerals.

FIG. 1 illustrates a rifle 102 having a scope adjustment system 100 mounted thereon. The system 100 comprises an adjustment mechanism 106 mounted onto a scope 104. As described below in greater detail, different embodiments of the adjustment mechanism 106 can be either mounted to an existing scope, or be an integral part of a scope. The system 100 further comprises a remote controller 110 configured so as to allows a shooter to control the adjustment mechanism 106 without having to significantly interrupt the shooter's scope sight picture or the shooting posture.

It will be appreciated that the remote controller (110 in FIG. 1) may comprise any number of configurations of various types of switches and combinations thereof. In the description herein, the controller is depicted as an assembly of four switches—two for controlling the elevation adjustment of the scope, and two for controlling the windage adjustment of the scope. It should be understood, however, that such a switch arrangement is exemplary, and any number of other configurations of switches may be utilized without departing from the spirit of the present teachings.

For example, the remote controller may comprise a single joystick-type device having a stubby stick manipulator adapted for easy manipulation by a trigger finger. Such a device may include internal switching mechanisms that provide either on-off functions for controlling the exemplary elevation and windage adjustments. Alternatively, the internal switching mechanism may allow proportional type response to the shooter's manipulation of the switch, such that a hard push results in a greater response than a slight push of the joystick.

Furthermore, although the remote controller is depicted to be located adjacent the trigger in the description, it will be appreciated that it could be located at other locations without departing from the spirit of the present teachings. For example, the shooter's thumb frequently manipulates functions such as a safety. Thus, the remote controller could be adapted to be located within reach of the thumb, and be manipulated by the thumb instead of the trigger finger. It should be apparent that any number of configurations of the remote controller (location and type) may be employed so as to be adaptable to various types of firearms or any other projectile launching devices.

The scope adjustment system is described herein in context of bolt-action and lever-action rifles. It will be understood, however, that the scope adjustment system may be adapted to work in any scoped firearms, including but not limited to, a semi-auto rifle, a selective-fire rifle, shotguns of different action types, handguns, and the like. The scope adjustment system may also be applicable in other projectile-launching devices having optical sights, such as various types of bows. Thus, it will be appreciated that the novel concepts of the scope adjustment system may be utilized on different platforms without departing from the spirit of the present teachings.

In a rifle scope, a point of aim (POA) is typically indicated by some form of a reticle. Common reticle configurations include a cross-hair type, a dot type, or some combination thereof. In a cross-hair reticle, the POA is typically at the intersection of two or more lines. In a dot reticle, the POA is the dot itself. For the purpose of description herein, the POA is indicated by a simple dot or a simple cross-hair. It will be appreciated, however, that the scope adjustment system may be employed with any number of reticle configurations without departing from the spirit of the present teachings.

Typically, the POA in a rifle scope can be adjusted for "elevation" to account for rise and fall of the bullet at its point of impact (POI). The POA can also be adjusted for "windage" to account for influences on the bullet that affect the horizontal displacement of the bullet at the POI. An elevation adjustment assembly is typically disposed at the top portion of the scope, and the windage adjustment assembly is typically disposed at one of the sides of the scope.

Figure 2C:
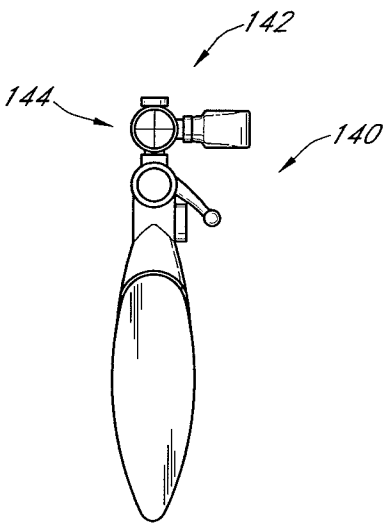
FIGS. 2A-C illustrate various end views of a rifle having various embodiments of the scope adjustment system adapted to allow adjustments of elevation and/or windage of a scope.
Figure 2B:
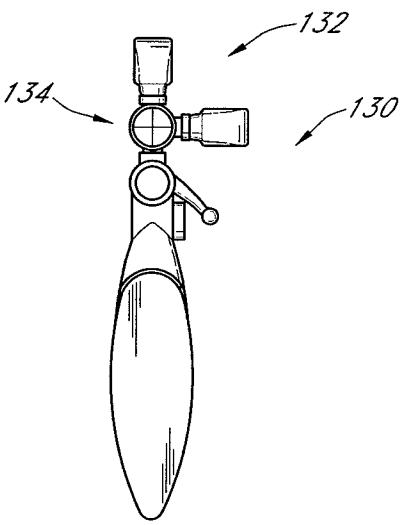
Figure 2A:
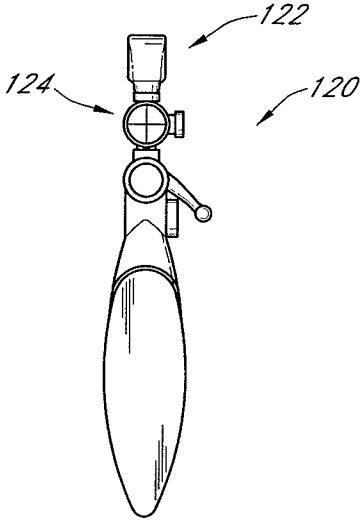

As shown in FIGS. 2A-C, the scope adjustment system may be implemented to allow adjustment of the elevation and/or the windage. In FIG. 2A, the end view of a rifle 120 illustrates an adjustment system 122 adapted to control the elevation adjustment of a scope 124. In FIG. 2B, the end view of a rifle 130 illustrates an adjustment system 132 adapted to control both the elevation and windage adjustments of a scope 134. In FIG. 2C, the end view of a rifle 140 illustrates an adjustment system 142 adapted to control the windage adjustment of a scope 144. Thus, it will be appreciated that the scope adjustment system may be adapted to control any of the controllable features of a scope, either singularly, or in any combination thereof.

Figure 3:
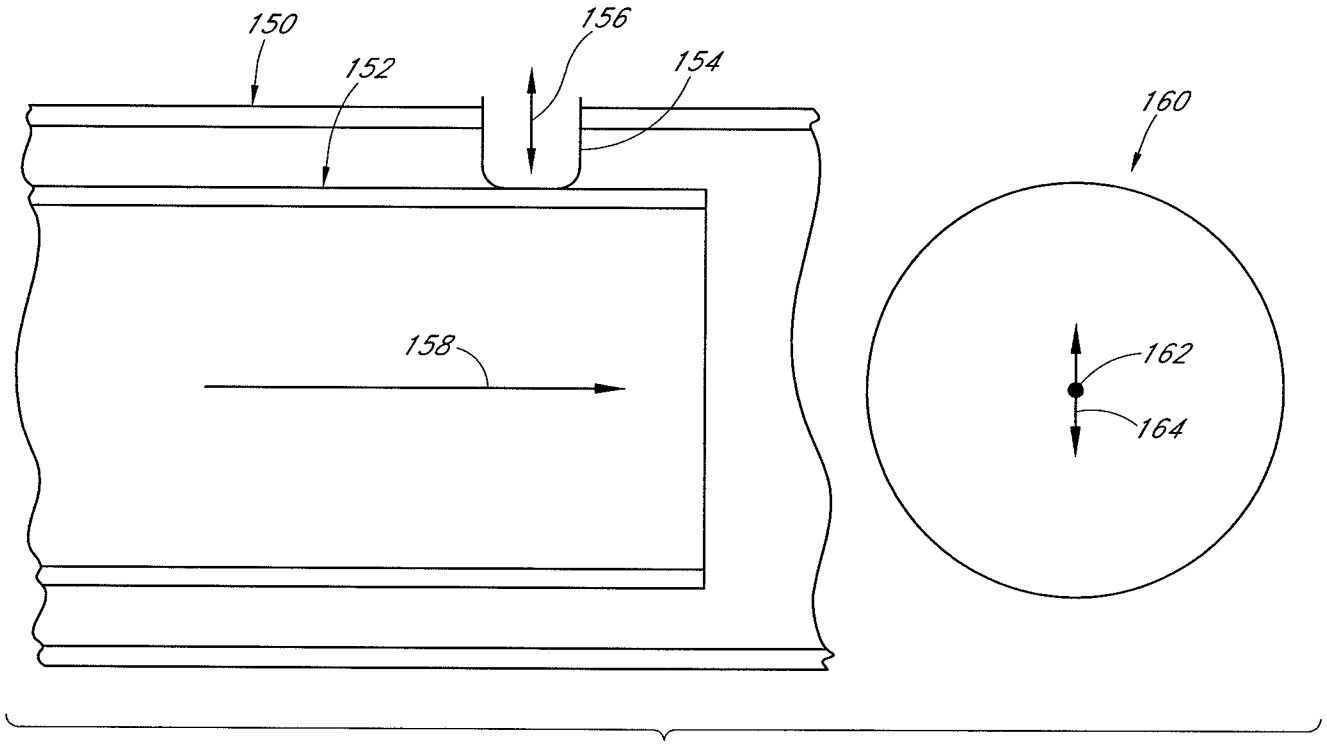
FIG. 3 illustrates a cutaway view of a scope depicting a adjustment tube disposed within the scope's housing, wherein lateral movements of the adjustment tube causes lateral adjustment of a point of aim with respect to the rifle.

FIG. 3 now illustrates a cutaway view of a portion of a scope having a housing 150 and an adjustment tube 152. The adjustment tube 152 may house optical elements (not shown) and the reticle (not shown). The adjustment of the POA may be achieved by moving the adjustment tube 152 (thereby moving the reticle) relative to the housing 150. Such motion of the adjustment tube 152 may be achieved by an actuator 154 adapted to move along a first direction indicated by an arrow 156. The first direction 156 is generally perpendicular to an optical axis indicated by an arrow 158. When the actuator 154 pushes against the adjustment tube 152, the tube 152 moves away from the actuator 154. When the actuator 154 is backed out, the adjustment tube 152 moves towards the actuator 154, induced by some bias not shown in FIG. 3.

The motion of the adjustment tube 152 along the first direction 156 causes a POA 162 in a scope field of view 160 to move along a direction 164 that is generally parallel to the first direction 156. It will be understood that the first direction 156 in FIG. 3 may represent a vertical direction for the elevation adjustment, or a horizontal lateral direction for the windage adjustment. As described below in greater detail, the actuator 154 may be moved by using different movement mechanisms.

One aspect of the present teachings relates to a scope adjustment system that allows a shooter to remotely control the actuator motion, thereby allowing the shooter to change the POA without having to take the sighting eye off the scope or significantly altering the shooting posture. Various embodiments of the scope adjustment system are described below.

Figure 4A:
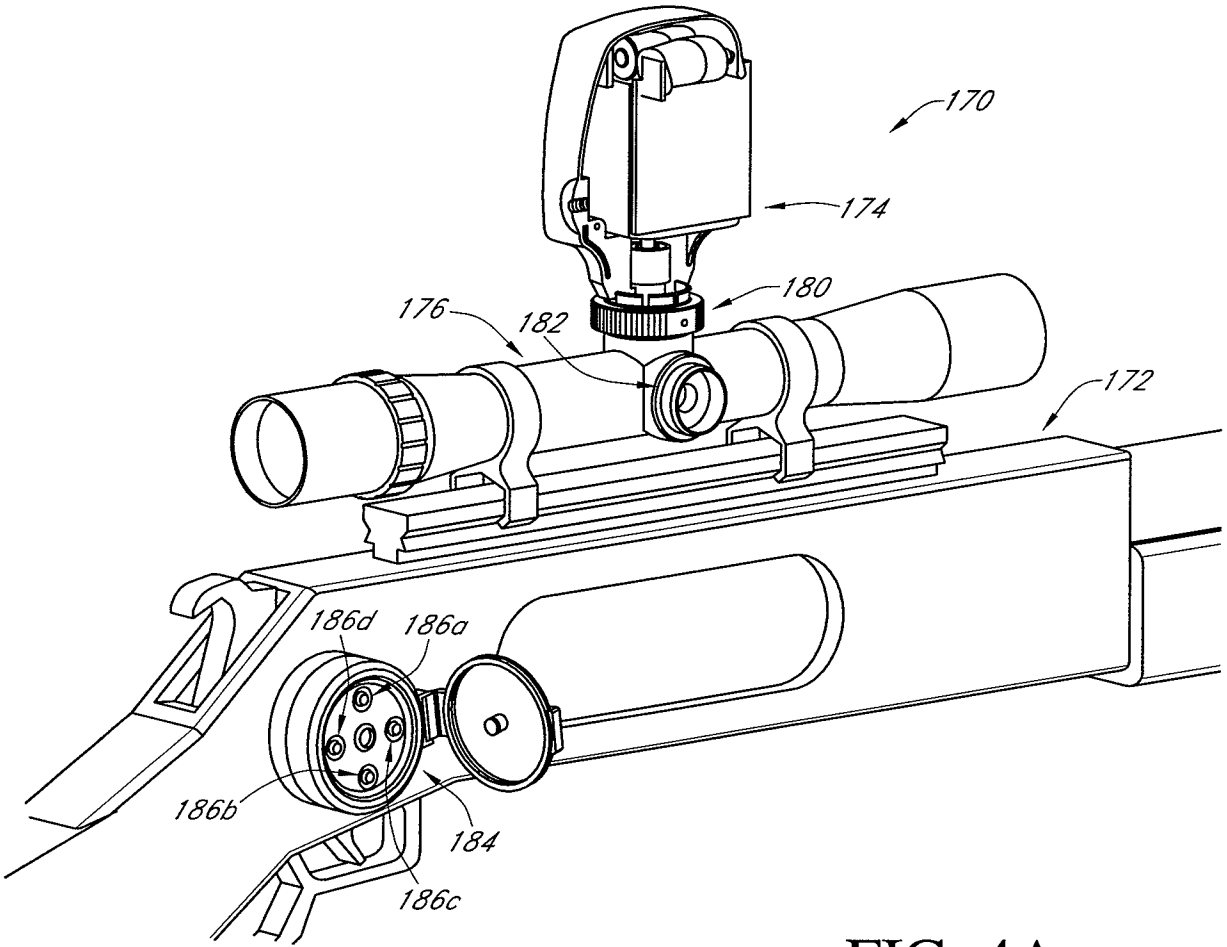
FIG. 4A illustrates one embodiment of the scope adjustment system mounted on an exemplary lever action rifle.

FIG. 4A illustrates one embodiment of a scope adjustment system 170 comprising an adjustment mechanism 174 mounted on a scope 176. The scope 176 is mounted on a rifle 172. The scope adjustment system 170 further comprises a remote controller 184 disposed near a trigger, so as to allow the shooter to manipulate the controller 184 with the trigger finger.

The scope adjustment system 170 in FIG. 4A is depicted as having the adjustment mechanism 174 coupled to the elevation adjustment portion by a coupling 180. It will be appreciated that another similar adjustment mechanism may be coupled to the windage adjustment portion 182 without departing from the spirit of the present teachings. Alternatively, an adjustment mechanism may be adapted to be a singular unit that couples to both the elevation and windage adjustment portions.

The remote controller 184 in FIG. 4A (and the controller 234 in FIG. 6 and the controller 390 in FIG. 13A) is depicted as having four buttons 186*a-d*. The top and bottom buttons 186*a* and 186*b* may be assigned to control respectively up and down movements of the POA in the scope field of view. Similarly, the front and rear buttons 186*c* and 186*d* may be assigned to control respectively left and right movements of the POA (if so equipped). However, the buttons can be configured in any sequence and the remote controller may also include more than four buttons without departing from the spirit of the present teachings. For example, a fifth button may be used to engage a "record" option of tracking the incremental adjustments being made to the vertical and windage deviations from POA to POI. A sixth button may be included that would engage a "save" option, such that when the incremental adjustments made to the vertical and windage adjustments are finished being "recorded"; such adjustments can then be "saved" by depressing the save button. Additional buttons may also be included that further control the optical magnification or focus of the scope's optical embodiments 388. The manner in which the remote controller 184 is mounted to the rifle 172, and the manner in which the remote controller 184 communicates with the adjustment mechanism 174, are described below in greater detail.

Figure 4B:
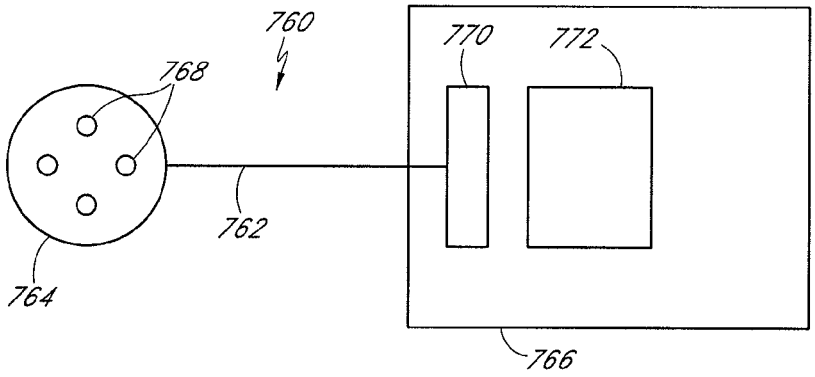
FIGS. 4B-C illustrate some possible embodiments of a signal link between a remote controller and an adjustment mechanism of the scope adjustment system.
Figure 4C:
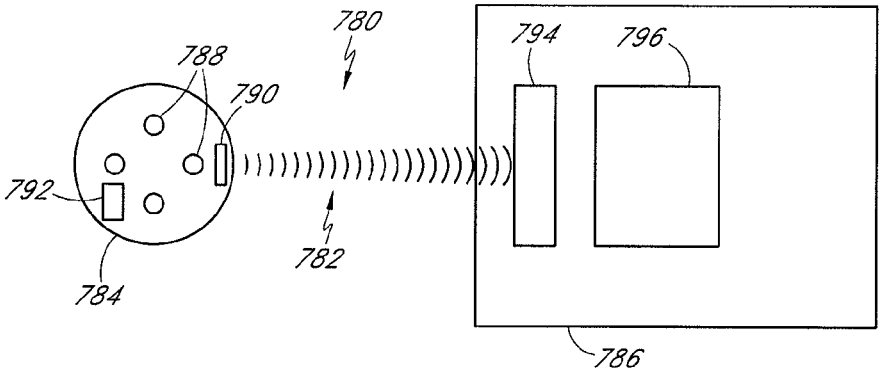

FIGS. 4B-C illustrate some possible embodiments of a signal link between the remote controller and the adjustment mechanism. Such links may be used for the scope adjustment system 170 of FIG. 4A or any other scope adjustment systems described herein.

FIG. 4B illustrates one embodiment of a signal link 760 comprising a wire connection 762 between a remote controller 764 and an adjustment mechanism 766. Manipulation of switches 768 may form switching circuits in a switching circuitry 770 that in turn induces the operation of a motor 772.

FIG. 4C illustrates another embodiment of a signal link 780 comprising a wireless transmitted signal 782 transmitted from a transmitter 790 of a remote controller 784. The transmitter 790 may be powered by a power source 792 such as a battery. Manipulation of switches 788 induces the transmitter to transmit corresponding signals 782 that are received by a receiver 794 disposed in an adjustment mechanism 786. The receiver 594 may then induce the operation of a motor 796 in response to the received signals.

Figure 5:
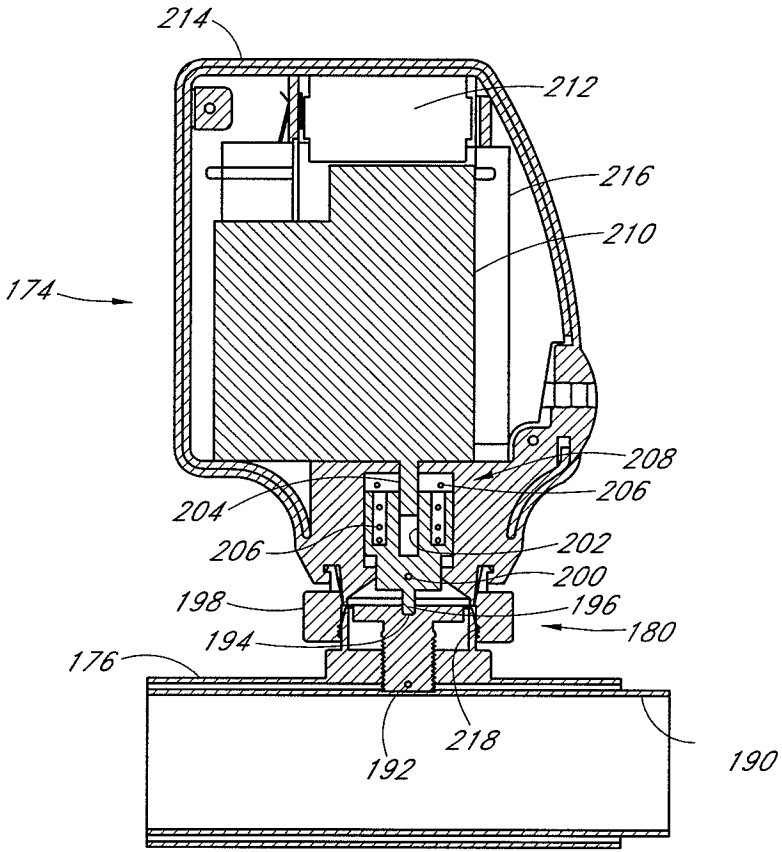
FIG. 5 illustrates a side cutaway view of part of the scope adjustment system of FIG. 4A.

FIG. 5 now illustrates a more detailed cutaway view of the adjustment mechanism 174. Overall, the adjustment mechanism couples a motor therein to an existing actuator, thereby allowing the motor to move the actuator. One embodiment 174 of the adjustment mechanism illustrated in FIG. 5 is adapted such that the coupling 180 comprises a threaded collar 198 that mates to a threaded portion (for receiving a cover) of an existing structure 218. An existing threaded actuator 192 disposed within the structure defines a slot 194 dimensioned to receive a turning tool such as a flathead screwdriver or a coin. Thus, by turning the threaded actuator 192 by a tool, the actuator 192 can move an adjustment tube 190 in a manner described above in reference to FIG. 3.

The adjustment mechanism 174 couples to the existing structure 218 by the collar 180. The threaded actuator 192 is turned by a flat head 196 of a driver member 200. The driver member 200 defines a recess 202 on the opposite end from the flat head 196, and the recess 202 is dimensioned to receive a motor shaft 204 therein, thereby providing a coupling 208 between the driver member 200 and a motor 210. Thus, when the motor shaft 204 turns, the flat head 196 turns in response, thereby causing motion of the threaded actuator 192 along a direction generally perpendicular to the optical axis of the scope. In one embodiment, the recess 202 is deep enough to accommodate the travel range of the driver member 200 with respect to the driver shaft 204. The coupling 208 between the motor 210 and the driver member 200 may also include a spring 206 that constantly urges the flat head 196 of the driver member 200 against the slot 194 of the threaded actuator 192.

In the embodiment 174 of the adjustment mechanism, the motor 210 is powered by a battery. The motor 210 rotates in response to a motor signal from a control unit 216 that results from a signal from the remote controller (not shown). A housing 214 houses the battery 212, motor 210, control unit 216, and the driver member 200.

It should be apparent that the motor 210 and the battery 212 can be selected from a wide variety of possible types, depending on the performance criteria. It will be appreciated that the motor 210 may be powered by a power source other than a battery without departing from the spirit of the present teachings. For example, the adjustment mechanism may be adapted to be powered by an external source, such as a battery adapter.

It will also be appreciated that the adjustment mechanism may be adapted to couple to numerous other types of scopes. For example, some scopes may have knobs (instead of slots) for turning the threaded actuators therein. In such scopes, coupling may, for example, be achieved by removing the knob(s) from the scope, and appropriately attaching the adjustment mechanism so as to couple the motor to the threaded actuator. Such attachment may utilize structures on the scope that allow the knobs to be attached thereon. It will also be appreciated that an independent adjustment mechanism may be incorporated into the housing and design of a rifle scope 13A. Such self-contained adjustment mechanism features could be fully integrated into the scope's internal housing at the time of manufacturing and is thus not be reliant on being "adapted" or "retrofitted" to a previously manufactured scope.

One aspect of the present teachings relates to an adjustment mechanism having a motor shaft oriented generally parallel to the optical axis of the scope. It will be seen from the description below that such orientation of the motor shaft, along with its coupling to the actuator (that extends generally perpendicular to the motor shaft), provides certain advantageous features.

Figure 6:
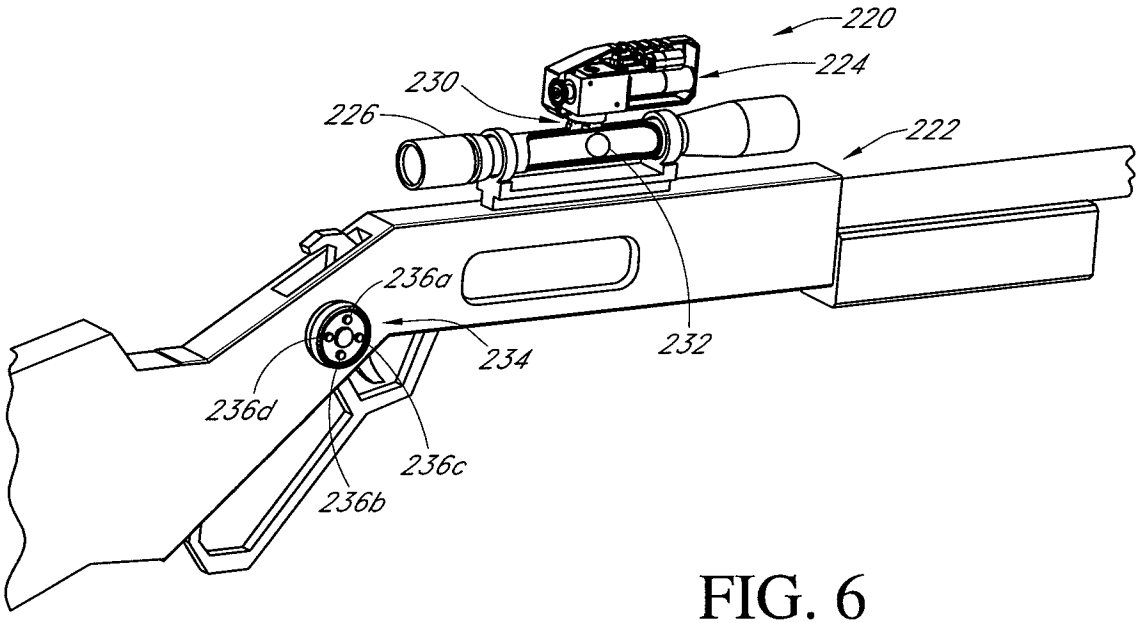
FIG. 6 illustrates another embodiment of the scope adjustment system.

FIG. 6 now illustrates one embodiment of a scope adjustment system 220 having such motor shaft orientation and perpendicular actuator. The system 220 comprises an adjustment mechanism 224 mounted on a scope 226. The scope 226 is mounted on a rifle 222. The system 220 further comprises a remote controller 234 disposed near a trigger, so as to allow the shooter to manipulate the controller 234 with the trigger finger.

The scope adjustment system 220 in FIG. 6 is depicted as having the adjustment mechanism 224 coupled to the elevation adjustment portion by a coupling 230. It will be appreciated that another similar adjustment mechanism may be coupled to the windage adjustment portion 232 without departing from the spirit of the present teachings. Alternatively, an adjustment mechanism may be adapted to be a singular unit that couples to both the elevation and windage adjustment portions.

The remote controller 234 in FIG. 6 is depicted as having four buttons 236*a-d*. The top and bottom buttons 236*a* and 236*b* may be assigned to control respectively up and down movements of the POA in the scope field of view. Similarly, the front and rear buttons 236*c* and 236*d* may be assigned to control respectively left and right movements of the POA (if so equipped). The remote controller 234 may communicate with the adjustment mechanism 224 in a manner described above in reference to FIGS. 4B-C.

Figure 7:
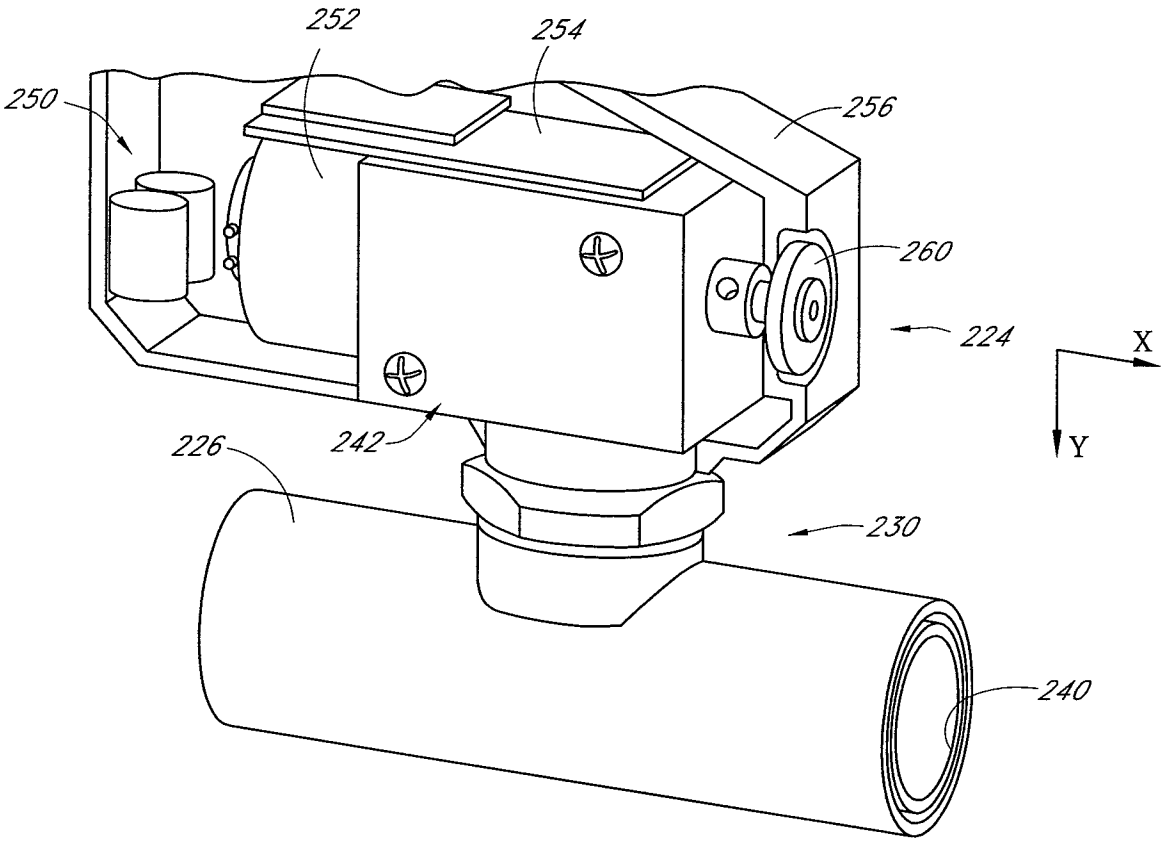
FIG. 7 illustrates a perspective partial cutaway view of part of the scope adjustment system of FIG. 6.

FIG. 7 illustrates a partial cutaway view of the adjustment mechanism 224 having a motor 252 mounted such that its shaft (not shown in FIG. 7) extends along a direction generally parallel to the optical axis. Again, the motor may be powered by a battery 250, or other source of power may be utilized. The motor 252 is controlled by a control unit 254 via a motor signal in response to an input signal from the remote controller (not shown).

The adjustment mechanism 224 further comprises a transfer mechanism 242 that facilitates transfer of motion along the X-axis to motion along the Y-axis in a manner described below. The motor shaft being oriented along the X-axis further allows the motor angular displacement (proportional to the X-motion and the Y-motion) to be visually monitored by a dial indicator 260. Such dial may face the shooter, and be calibrated with indicator marks to indicate commonly used POA displacement units. For example, many POA adjustment dials and knobs are calibrated in units of ¼ MOA (minute of angle). The dial indicator 260 may provide additional visual feedback to proper functioning of the scope adjustment system 224. It will be appreciated that the X-axis orientation of the motor shaft allows easier implementation of the indicator dial without complex coupling mechanisms.

In FIG. 7, the adjustment mechanism 224 is shown to be coupled via the coupling 230. The internal components within the transfer mechanism 242 and the coupling 230 are described below in greater detail. The transfer of the X-motion to the Y-motion allows moving of an adjustment tube 240 with respect to the scope tube 226 in a manner described below. In the embodiment 224 shown in FIG. 7, the battery 250, motor 252, and the transfer mechanism housing are enclosed within an outer housing 256.

Figure 8:
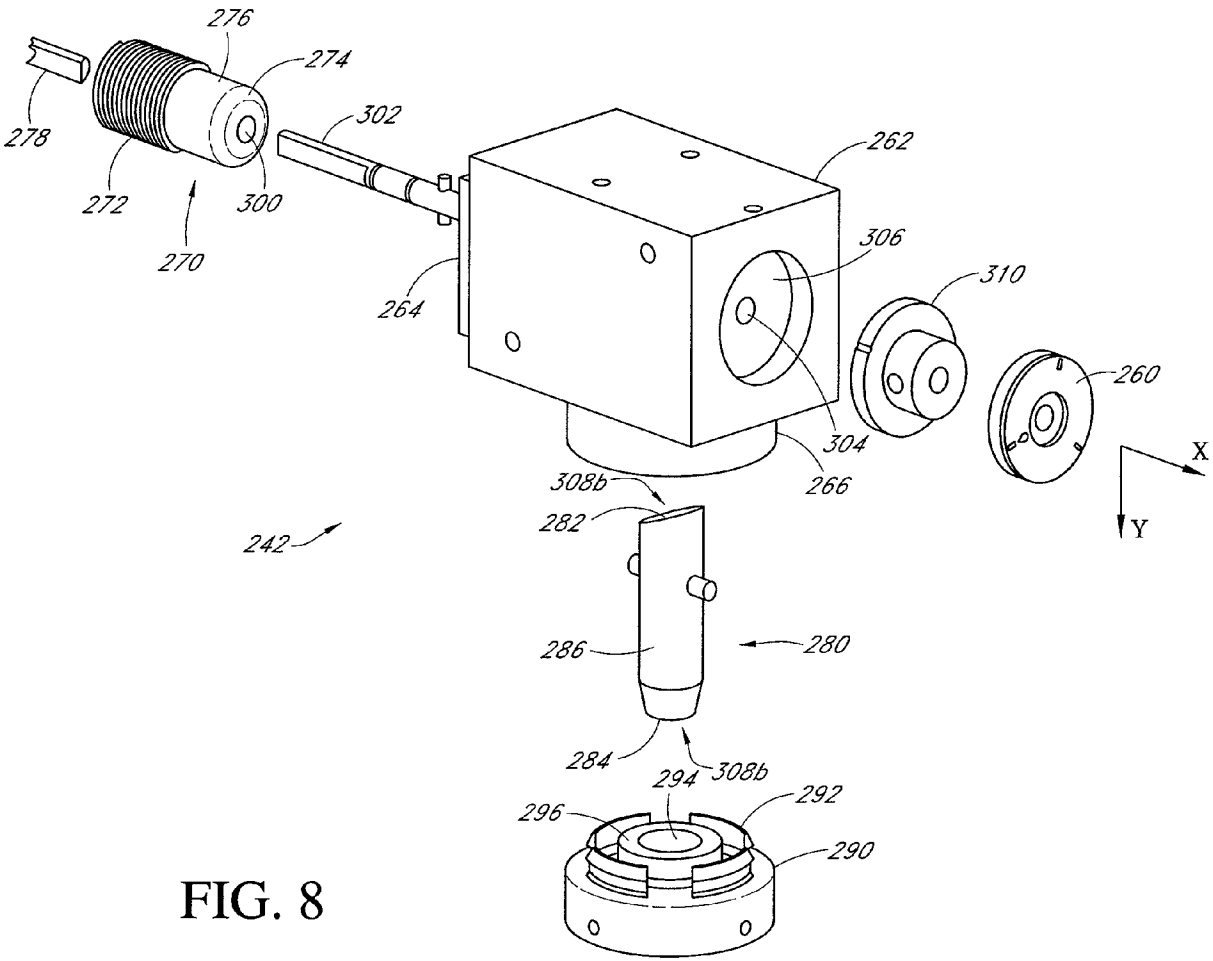
FIG. 8 illustrates a partially disassembled view of the part of the scope adjustment system of FIG. 7, showing the relative orientation of a driving bolt that induces generally perpendicular motion of an actuator.

FIG. 8 now illustrates a partially disassembled view of the transfer mechanism 242. The mechanism 242 comprises a housing 262 having an input portion 264 and an output portion 266. The input portion 264 is adapted to receive a bolt 270. In one embodiment, the bolt 270 comprises an elongate member having a threaded portion 272, an engagement surface 274, and a smooth portion 276 therebetween. The threaded portion 272 is adapted to engage its counterpart threads (shown in FIGS. 9 and 10) within the housing 262. The bolt 270 defines an aperture 300 that extends along the axis of the bolt 270. The aperture 300 is dimensioned to allow the bolt to be rotated by a motor shaft 278, while allowing relatively free longitudinal (sliding) motion of the shaft 278 within the aperture 300. In one embodiment, the aperture and shaft cross sections are dimensioned and include a flat (key) portion in an otherwise round shape, so as to allow positive rotational coupling therebetween while allowing the bolt 270 to slide on the shaft 278. Thus, when the shaft 278 is turned by the motor, the shaft 278 causes the bolt 270 to rotate as well. Because the bolt's threaded portion 272 is in engagement with the counterpart threads in the housing 262, rotating bolt causes the bolt 270 to move along the X-axis relative to the housing 262. The keyed coupling via the aperture 300 allows the bolt 270 to slideably move relative to the shaft 278.

One aspect of the present teachings relates to transferring the motion of a driven bolt along a first direction to the motion of an actuator along a second direction. In FIG. 8, the bolt 270 is driven along the X-axis in the manner described above. The transfer mechanism 242 further comprises an assembly 280 having an actuator 286 that extends along the Y-axis. The actuator 286 comprises a generally elongate member having a first end 308*a* and a second end 308*b*. The first end 308*a* defines an angled surface 282 that forms an angle relative to a plane perpendicular to the axis of the actuator 286. The angled surface 282 engages the engagement surface 274 of the bolt 270 to cause transfer of directionality of motion in a manner described below. The second end 308*b* defines an adjustment tube engagement surface 284 that engages the adjustment tube (240 in FIG. 7).

The first end 308*a* of the actuator 286 is positioned within the housing 262 through the output portion 266 of the housing 262 and engages the bolt 270 in a manner described below. The second end 308*b* of the actuator 286 is positioned within the scope (226 in FIG. 7). In one embodiment, the second end 308*b* of the actuator 286 extends through an aperture 294 defined by a guide member 296. The guide member 296 may be a part of an interface assembly 290 that allows formation of the coupling 230 (FIG. 7) of the adjustment mechanism 224 to the scope 226. The interface assembly 290 may further comprise latching members 292 that allow the coupling 230 to be secure.

As also seen in FIG. 8, the X-axis orientation of the motor shaft 278 allows a simple coupling of the motor output to the dial indicator 260 described above in reference to FIG. 7. In one embodiment, the transfer mechanism 242 further comprises a dial coupling pin 302 that extends in the X-direction. The motor end of the pin 302 is dimensioned to fit into the keyed aperture 300 defined by the bolt 270. The dial end of the pin 302 is dimensioned to extend through a dial coupling aperture 304 defined by the housing 262 at a location generally opposite from the input portion 264. The area adjacent the dial coupling aperture 304 may be recessed to form a recess 306 dimensioned to receive a dial coupling member 310. The coupling member 310 couples the pin 302 to the dial 260. It should be understood that there are a number of ways the dial 260 can be coupled to the motor shaft 278 without departing from the spirit of the present teachings.

Figure 9:
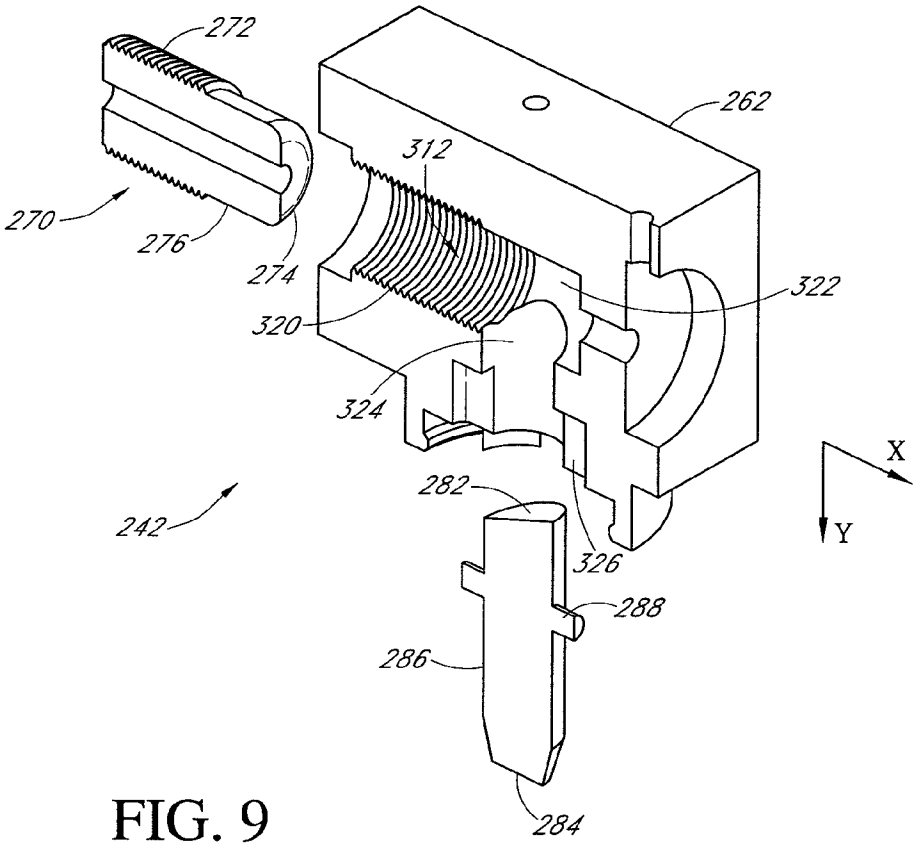
FIG. 9 illustrates a cutaway view of part of the scope adjustment system of FIG. 8, showing the positioning of the bolt with respect to the actuator.

FIG. 9 now illustrates a cutaway view of the transfer mechanism 242 showing the internal structure of the housing 262. The housing 262 defines an input aperture 312 having a threaded-wall portion 320 and a smooth-wall portion 322. The input aperture 312 extends generally along the X-axis. The threaded-wall portion 320 is adapted to mate with the threaded portion 272 of the bolt 270, and the smooth-wall portion 322 is dimensioned to receive the smooth portion 276 of the bolt 270, and to allow X-motion of the engagement surface 274.

The housing 262 further defines an output aperture 324 that extends generally along the Y-axis. The output aperture 324 is dimensioned to receive the actuator 286 and allow Y-motion of the actuator 286 as a result of the engagements of the angled surface 282 and the adjustment tube engagement surface 284 with the engagement surface 274 of the bolt 270 and the adjustment tube (240 in FIG. 7), respectively.

Because the orientation of the angled surface 282 with respect to the bolt 270 (the angle between the bolt's axis and angled surface's normal line) affects the manner in which motion is transferred, it is preferable to maintain such an orientation angle substantially fixed. One way of maintaining such a fixed orientation angle is to inhibit the actuator 286 from rotating about its own axis with respect to the bolt 270. In one embodiment, the actuator 286 includes guiding tabs 288. The housing 262 further defines guiding slots 326 adjacent the output aperture 324. The guiding tabs 288 and the guiding slots 326 are dimensioned so as to inhibit rotational movement of the actuator 286 about its axis, while allowing Y-motion of the actuator 286.

Figure 10:
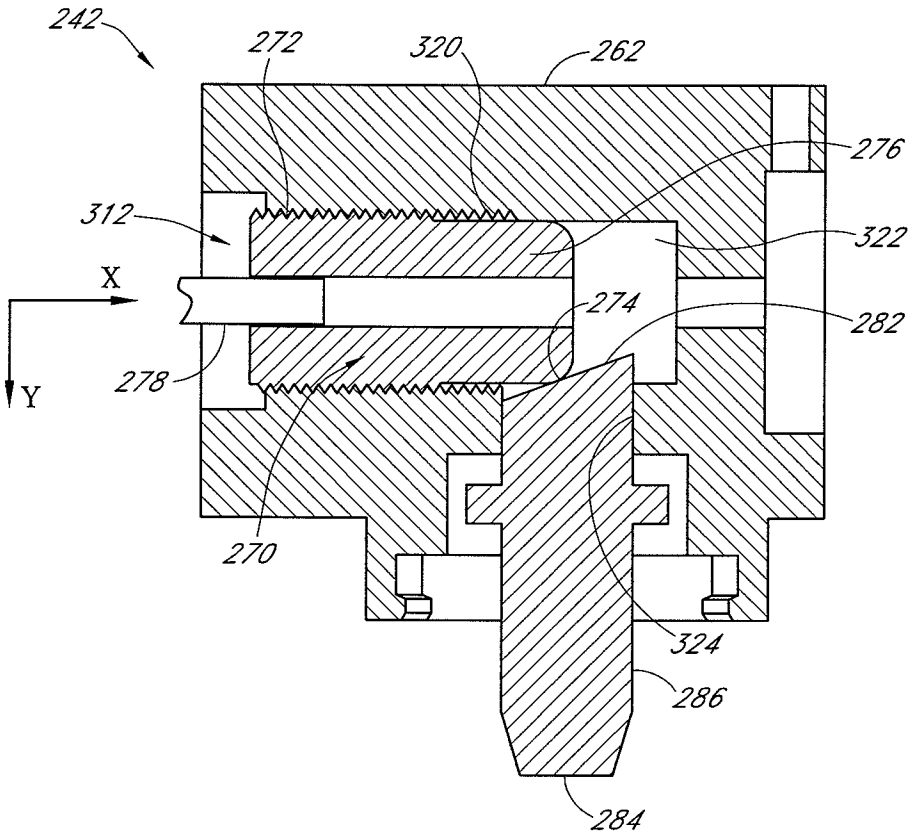
FIG. 10 illustrates a side view of part of the scope adjustment system of FIG. 9, showing the engagement of the bolt with an angled surface of the actuator.

FIG. 10 now illustrates a sectional side view of the transfer mechanism 242. In particular, the engagement between the bolt 270 and the actuator 286 is shown clearly. Along the X-axis, the threaded portion 272 of the bolt 270 mates with the threaded-wall portion 320 of the input aperture 312, and the smooth portion 276 of the bolt 270 extends into the smooth-walled portion 322 of the input aperture 312. Along the Y-axis, the actuator 286 extends into the output aperture 324 such that the angled surface 282 engages the engagement surface 274 of the bolt 270.

With such a transfer mechanism configuration, rotation of the bolt 270 by the shaft 278 causes the bolt 270 to move along the X-axis. If the bolt 270 moves towards the angled surface 282, the transferred motion causes the actuator 286 to move away from the bolt 270. Such a motion of the actuator 286 causes the adjustment tube engagement surface 284 to push against the adjustment tube. As previously described, the adjustment tube may be biased (by some spring, for example) towards the actuator. Thus, if the bolt 270 moves away from the angled surface 282 (via the counter-rotation of the bolt), the actuator 286 is able to move towards the bolt 270, and the bias on the adjustment tube facilitates such movement of the actuator 286. Thus, it will be appreciated that the Y-motion of the actuator 286 is induced by the X-motion of the bolt 270.

Figure 11:
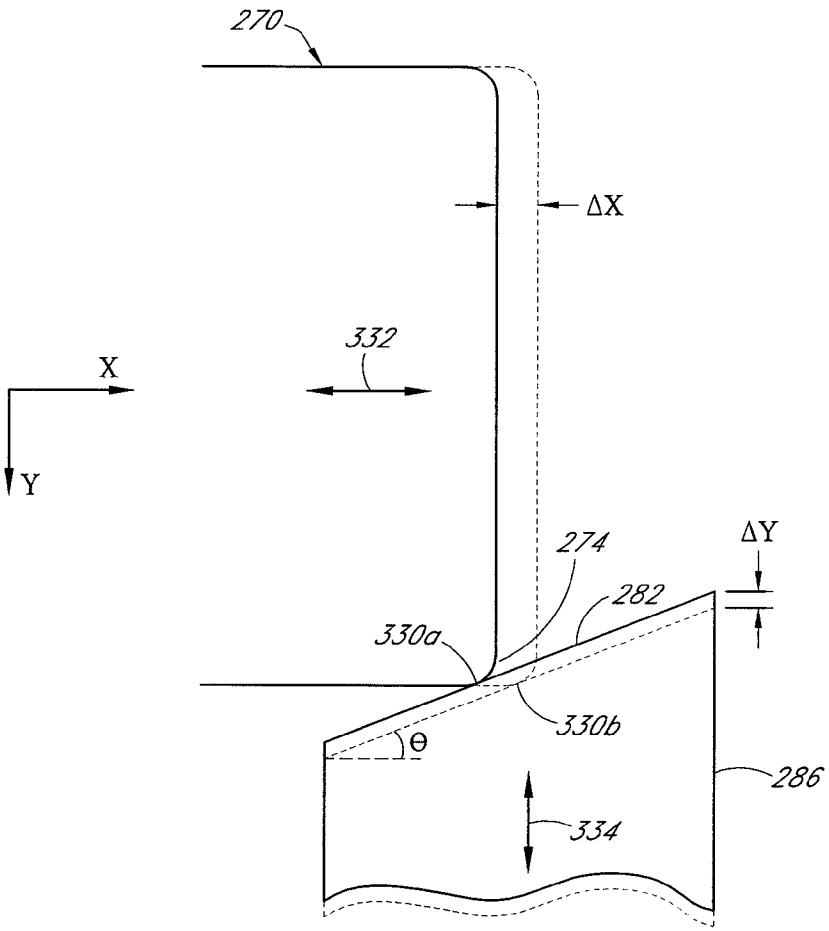
FIG. 11 illustrates how the motion of the bolt along the exemplary X-direction is translated into the exemplary Y-direction, wherein the angle of the angle surface determines the ratio of movement magnitudes between the X and Y movements.

FIG. 11 illustrates an expanded view of the engagement between the bolt 270 and the actuator 286. In particular, FIG. 11 shows how the configuration of the angled surface 282 affects the movement transfer. In one embodiment, the plane defined by the angled surface 282 is substantially perpendicular to the plane defined by the bolt's axis (X-axis) and the actuator's axis (Y-axis). In such a configuration, angle θ defines the angle of the angled surface 282 with respect to the X-axis.

As previously described, the bolt 270 motion is substantially restricted along the X-axis (as shown by an arrow 332), and the actuator 286 motion is substantially restricted along the Y-axis (as shown by an arrow 334). As such, two exemplary engagement positions, 330*a* and 330*b*, of the engagement surface 274 are depicted as solid and dotted lines, respectively. The X-displacement between the two positions of the bolt 270 is denoted as ΔX. The corresponding positions of the actuator 286 are depicted respectively as solid and dotted lines. The corresponding Y-displacement of the actuator 286 is denoted as ΔY. From the geometry of the engagement configuration, one can see that ΔX and obey a simple relationship $$\Delta Y = \Delta X \tan \theta. \quad (1)$$

One can see that tan θ is effectively a "reduction" (or an "increasing") term. For θ between 0 and 45 degrees, the value of tan θ ranges from 0 to 1. For θ between 45 and 90 degrees, the value of tan θ ranges from 1 to a large number. In the scope application, a fine control of ΔY is usually desired. Thus, by selecting an appropriate angle θ, one can achieve the desired ΔY resolution without having to rely on a fine resolution motor.

As an example, an angle of 20 degrees yields a reduction factor of approximately 0.364. If one selects an exemplary thread count of 32 (threads per inch) for the bolt threads, one rotation of the bolt results in ΔX of approximately 0.03125", and the resulting ΔY would be approximately 0.03125"× 0.364=0.0114". It should be understood that any number of other thread pitches of the bolt and angles of the angled surface may be utilized without departing from the spirit of the present teachings.

It will be appreciated that the X-Y motion transfer performed in a foregoing manner using an angled surface benefits from advantageous features. One such advantage is that because any value of the angle of the angled surface can be selected during fabrication of the actuator, the reduction factor comprises a continuum of values, unlike discrete values associated with reduction gear systems. Another advantage is that for a given reduction value (i.e., given angle), the substantially smooth angled engagement surface allows a substantially continuous motion transfer having a substantially linear response.

It will be appreciated that the novel concept of transferring motion via the angled engagement surface can be implemented in any number of ways. In the description above in reference to FIGS. 8-11, the bolt 270 and the actuator 286 are generally cylindrical shaped structures. It should be understood, however, that any number of other shaped structures may be utilized for the bolt and/or the actuator. Furthermore, the bolt does not necessarily have to be moved via the threaded means. It could be pushed/pulled in a non-rotating manner by some other linear driving device. Thus, for example, a non-rotating bolt having a non-circular sectional shape may engage an angled surface of an actuator having a non-circular sectional shape, and provide similar reduction factor in transferred motion without departing from the spirit of the present teachings. Moreover, while the transfer mechanism 242 is described for use in conjunction with the adjustment of a telescopic sight for a firearm, such transfer mechanism (or some mechanism similar to it) can also be used in any of a number of different implementations where fine control adjustment is needed without departing from the spirit of the present teachings.

It will also be appreciated that in certain embodiments, the motion transfer between a driving shaft and an actuator is achieved by other means. For example, a cam device may be attached to the driving shaft, and one end of the actuator may be adapted to engage the cam so as to provide a variable actuator position depending on the cam's (thus driving shaft's) orientation with respect to the actuator. In another example, a driving shaft may be oriented generally parallel (but offset) to an actuator. The end of the shaft may comprise a curved surface such that an end of the actuator engages the curved surface of the shaft. When the shaft is made to rotate, the curved and offset surface causes the actuator to change its position.

Figure 12A:
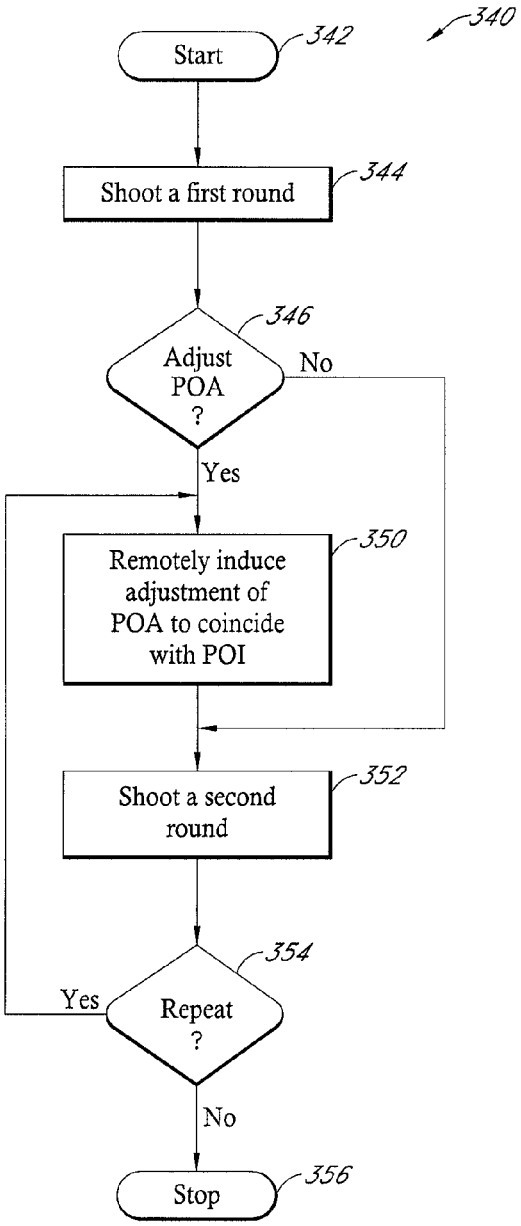
FIG. 12A illustrates one possible process for adjusting a point of aim with respect to a point of impact of a bullet.
Figure 12B:
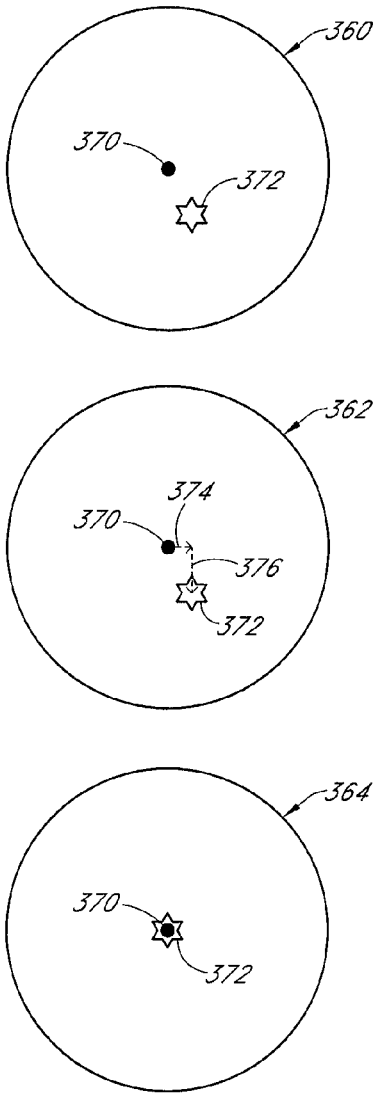
FIG. 12B illustrates a relative position of the point of aim and the point of impact during the process of FIG. 12A.

The scope adjustment system described above allows a shooter to adjust the POA to coincide with the bullet's POI while maintaining the scope sight picture and not significantly altering the shooting posture. FIG. 12A illustrates one possible implementation of a process 340 for such adjustment of the POA. FIG. 12B illustrates various scope sight pictures corresponding to various steps of the process 340.

The process 340 begins at a start state 342, and in state 344 that follows, the shooter shoots a first round at a target. After the first shot is made, a scope sight picture 360 shows that a POI 372 of the first round is displaced from a POA 370. Such POA-POI discrepancy is depicted for the purpose of describing the adjustment process. The POA may coincide with the POI sufficiently, in which case, adjustment is not necessary. In a decision state 346, the shooter determines whether the POA should be adjusted. If the answer is "No," then the scope adjustment is not performed, and the shooter can either shoot a second round in state 352, or simply stop shooting in state 354.

If the answer to the decision state 346 is "Yes," then the shooter remotely induces adjustment of the POA in state 350 such that the POA 370 is moved to the POI 372. One possible movement sequence of the POA 370 is depicted in a scope sight picture 362, as a horizontal (windage) correction 374 followed by a vertical (elevation) correction 376. It will be appreciated that the movement of the POA to the POI may comprise any number of sequences. For example, the vertical movement may be performed before the horizontal movement without departing from the spirit of the present teachings. Furthermore, the POA movement sequence depicted in FIG. 12B assumes that the scope adjustment system controls both the elevation and windage adjustments. As previously described, however, only one of elevation or windage adjustments may be performed in a similar manner without departing from the spirit of the present teachings.

Once the POA is adjusted in state 350, the shooter, in state 352, may shoot a second round to confirm the adjustment. A scope sight picture 364 depicts such a confirmation, where the POA 370 coincides with the POI 372.

The portion of the process 340 described above may be repeated if the shooter determines in a decision state 354 to do so. If the adjustment is to be repeated, the process 340 loops back to state 350 where another remotely induced adjustment is made. If the adjustment is not to be made ("no" in decision state 354), the process 340 ends in state 356.

It will be understood that the meaning of "POA coinciding with POI" does not necessarily mean that a particular given bullet's POI coincides precisely with the POA. As is generally understood in the art, the intrinsic accuracy of a given rifle may cause several POIs to "group" at the target, regardless of the shooter's skill. Thus, the POA preferably should be positioned at the center of the group of POIs. In certain situations, the shooter may decide that even if the second shot does not place the POA precisely on the POI, the adjustment is good enough for the intended shooting application. Thus, it will be appreciated that whether or not the adjusted POA coincides precisely with the POI in no way affects the novel concept of scope adjustment described herein.

It will also be appreciated that the quick and efficient POA adjustment described above does not depend on the shooter's knowledge of the ballistic parameters such as target distance, wind speed, or bullet properties, provided that these parameters do not change significantly during the adjustment. The POA adjustment is simply performed based on the initial empirical POA-POI discrepancy. If one or more parameters change, the POA may be re-adjusted in a similar manner, again in a quick and efficient manner. For example, a change in the ammunition may change the bullet type and the ballistics of the bullet's trajectory, thereby changing the POI. A target distance change may cause the POI to change from that of the previous distance. A change in wind speed or direction also may cause the POI to change.

It will be appreciated that various embodiments of the rifle scope described herein allows a shooter to adjust the POA with respect to the POI without having to disturb the shooting posture or the scope sight picture. Such an advantage is provided by various embodiments of the remote controller disposed at an appropriate location (such as adjacent to the trigger for the trigger finger manipulation or adjacent a thumb-operated safety for thumb manipulation), and various embodiments of the adjustment mechanism that responds to the manipulation of the remote controller. As is known in the art, maintaining a proper shooting posture greatly improves the shooter's ability to deliver the bullet to a desired target location.

It will also be appreciated that the aforementioned advantageous features can naturally be extended to other forms of hand-held firearms (such as handguns) and other projectile launching devices (such as bows) equipped with optical sighting devices. As is also known, a proper "shooting" posture and maintaining of such posture in these non-rifle applications also improve the "shooter's" ability to deliver the projectile to its intended target location in an accurate manner.

FIGS. 13-20 now illustrate various embodiments of an integrated scope system that advantageously incorporates one or more ballistic parameter in determining and effecting a corresponding POA adjustment. In one aspect, such a system allows a shooter to acquire a target, and the one or more ballistic parameter. The system further determines the necessary POA adjustment based on the ballistic parameter(s), and causes the POA to be adjusted accordingly. It will be appreciated that such a system is particularly useful in situations where some of the ballistic parameters can change relatively quickly (such as hunting).

Figure 13A:
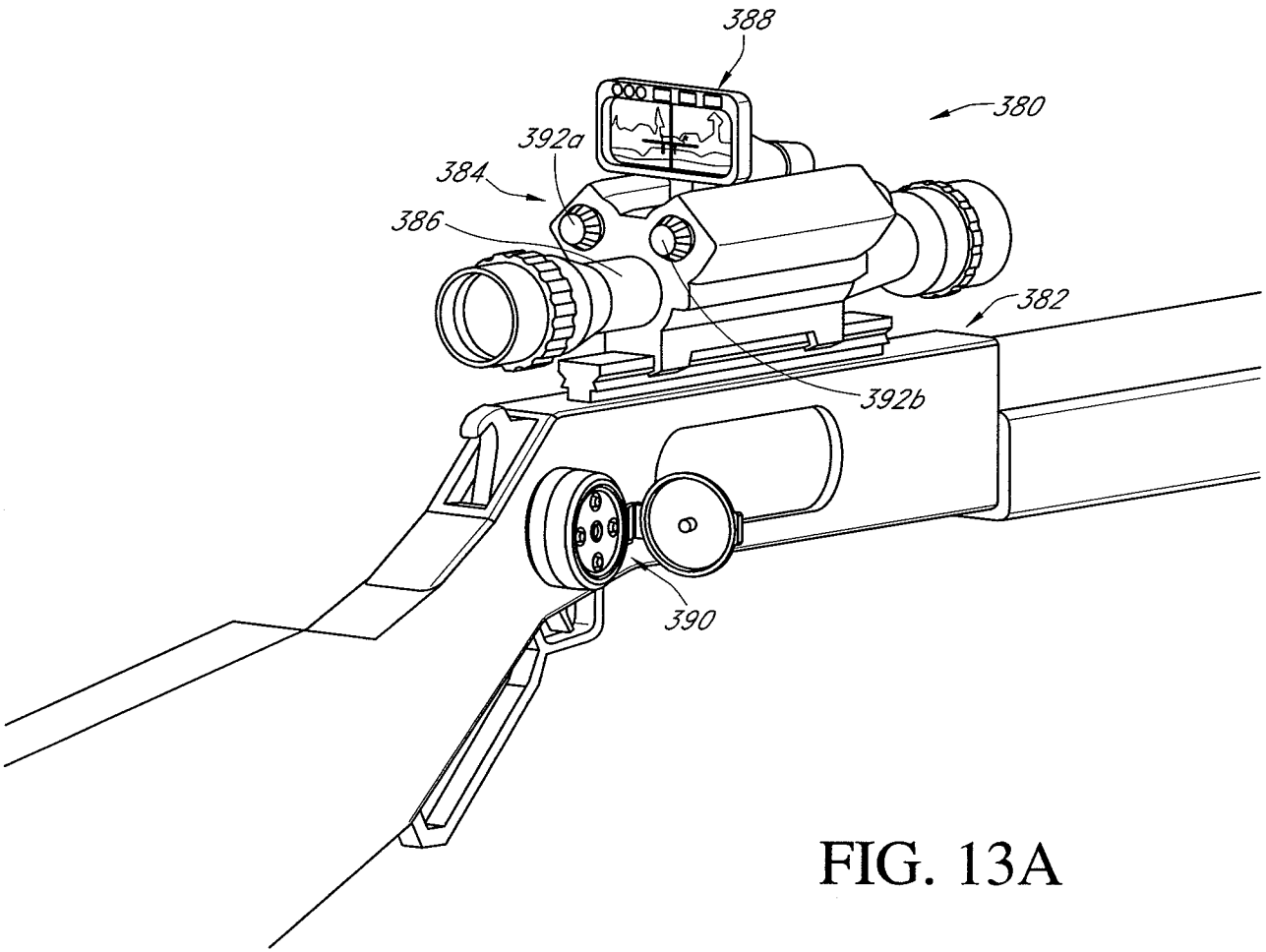
FIG. 13A illustrates another embodiment of a scope adjustment system, wherein the system includes a component that provides at least one ballistic parameter associated with the bullet or the shooting environment to a processor that predicts where the point of impact will be at based on the input parameter.

FIG. 13A illustrates one embodiment of an integrated scope system 380 comprising a scope 386 with an adjustment system 384 coupled thereto, and an optical auto-zoom and auto-focus device 388 also coupled thereto. The adjustment system 384 may include a remote controller 390 that can function in a manner described above, and/or as selector switches for various other functions as described below. The integrated scope system 380 is shown to be mounted on a rifle 382.

The adjustment system 384 may use any of the previously described adjustment mechanisms without departing from the spirit of the present teachings. The system 384 in FIG. 13A is depicted as having an automatic electronically-controlled elevation adjustment indicator dial 392*a* and an automatic electronically-controlled windage adjustment indicator dial 392*b*. These automatic electronically-controlled adjustment mechanisms are controlled by a combination of an internal processor and internal controller system, one embodiment of which is shown in FIG. 14C, all of which may be internally housed and integrated into scope's design. A transfer mechanism similar to that described above in reference to FIGS. 8-10 may be utilized to effect and monitor each of the elevation and windage adjustments. Alternatively, any number of other transfer mechanisms may be utilized in the adjustment system without departing from the spirit of the present teachings.

Figure 13B:
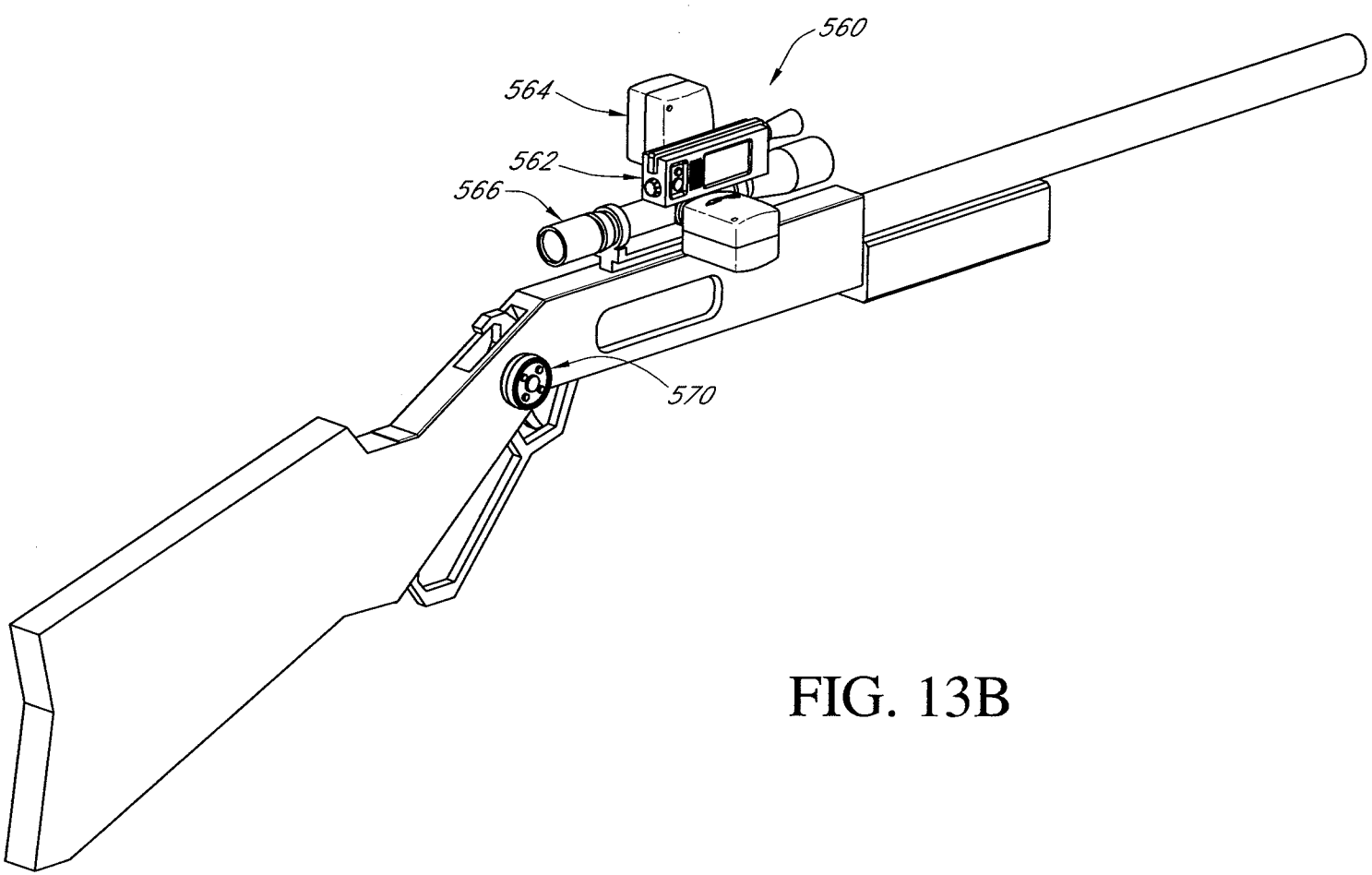
FIG. 13B illustrates another embodiment of a scope adjustment system having a detached ballistic parameter determining component similar to that of FIG. 13A.

FIG. 13B illustrates another embodiment of a scope system 560 having a scope 566 with an adjustment system 564 coupled thereto, and a ballistic parameter device 562 detached from the adjustment system 564. The ballistic parameter device 562 is shown to be attached to the scope 566, but not to the adjustment system 564. The ballistic parameter device may determine one or more ballistic parameters, determine the adjustment based on the ballistic parameter(s), and communicate a signal representative of the adjustment to the adjustment system 564. As described herein, such communication of the signal between the ballistic parameter device 562 and the adjustment system 564 may be achieved by either a wire-based link or a wireless link.

Figure 13C:
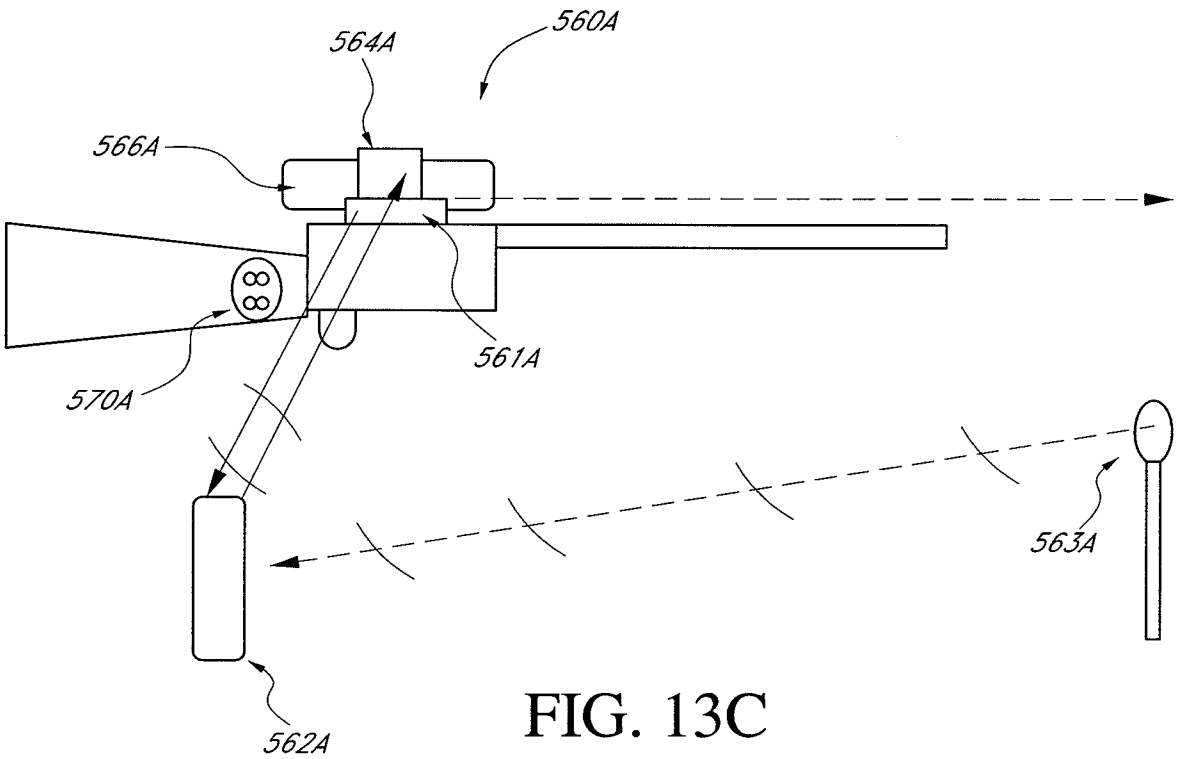
FIG. 13C illustrates another embodiment of a scope housing system 560A having a scope 566A with an adjustment system 564A.

FIG. 13C illustrates another embodiment of a scope housing system 560A having a scope 566A with an adjustment system 564A coupled thereto or integrated therein during manufacture. This embodiment also has a ballistic parameter and controller device 562A that is physically separated from both the adjustment system 564A and the scope housing system 560A. The ballistic parameter and controller device 562A controls the adjustment system 564A. The ballistic parameter controller device can be wire-based linked or wireless link that may receive yardage and slope data from the range finder and/or inclinometer 561A. The ballistic parameter and controller device 562A can also be fed wind data, temperature data and other environmental field data from a remote sensing device 563A. The remote sensing device 563A may be wirelessly linked to the ballistic parameter and controller device 562A. The ballistic parameter and controller device 562A may be hand-held or attached to a marksman's belt, or positioned in any manner that the marksman prefers. The ballistic parameter and controller device 562A may be a small notebook computer, a programmable iPod, or any similar device capable of downloading and executing the necessary parameter software. The ballistic parameter and controller device 562A may determine one or more ballistic parameters from the data gathered from the range finder and inclinometer 561A and the remote sensing device 563A and then calculate the required POA to POI adjustment based on these ballistic parameter(s). The ballistic parameter and controller device 562A may then transmit a data signal representative of the required vertical and windage adjustment for the POA to POI adjustment to the adjustment system 564A. As described herein, such communication of the signal between the ballistic parameter controller device 562A and the adjustment system 564A may be achieved by either a wire-based link or a wireless link.

The rifles illustrated in FIGS. 13B and 13C also depict a remote controller 570, 570A which may be configured to control the adjustment system 564, 564A directly, control the adjustment system 564, 564A through the ballistic parameter controller device 562, 562A, control the operation of the ballistic parameter controller device 562 and 562A, or any combination thereof. The link between the remote controller 570 and the ballistic parameter controller device 562, 562A and/or the adjustment system 564 564A, may be achieved by wireless link, wire-based link, or any combination thereof.

The adjustment system 564, 564 A in FIGS. 13B and 13C comprises the elevation and windage adjusting mechanisms. It will be appreciated that such depiction is in no way intended to limit the scope of the present teachings with respect to the usage of the detached ballistic parameter controller devices 562, 562A. Such a device can also be used in conjunction with either of the elevation or windage adjusting mechanism separately without departing from the spirit of the present teachings. It will also be appreciated that such a device can be used in conjunction with any of the various embodiments of the adjusting mechanisms described herein.

It will also be appreciated that although the detached ballistic parameter device 562 in FIG. 13B is depicted as being mounted to the scope 566, such device could be mounted in other locations on the rifle without departing from the spirit of the present teachings. For example, the ballistic parameter device could be adapted to be mounted on the forestock, under the barrel, and on other similar locations. The ballistic parameter device could also be mounted between the rifle and the scope by adapting the device to mount to the rifle and having the scope mount on top of the ballistic parameter device. The ballistic parameter device, the scope, and/or the adjustment system may be integrated into a single device.

It will also be appreciated that by having a detached ballistic parameter, such device could be used in conjunction with an existing adjustment system without having to retrofit or replace the scope/adjustment assembly. Some of the possible functionalities of the detached ballistic parameter device 562 are described below in greater detail.

Figure 14A:
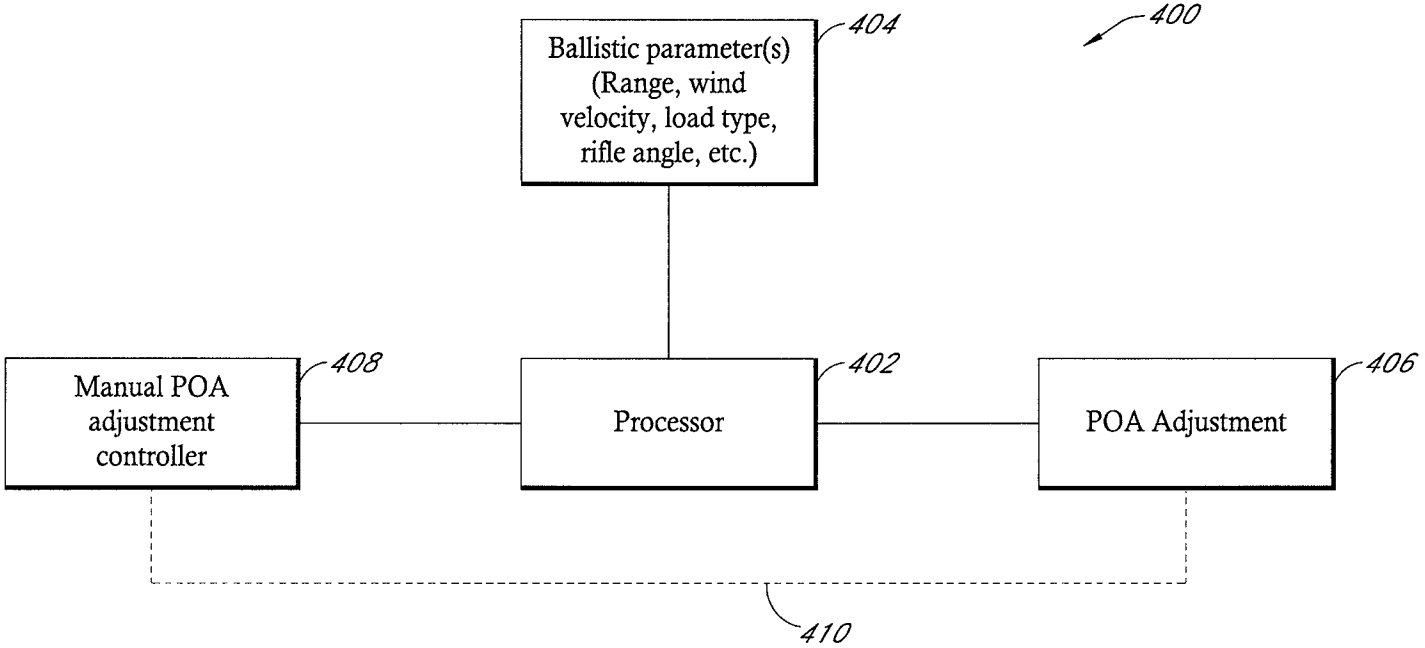
FIG. 14A illustrates a functional block diagram showing how the processor can be configured to integrate the ballistic parameter to induce adjustment of the point of aim with respect to the point of impact.

FIG. 14A illustrates a functional block diagram 400 showing integration of some of various components of the integrated scope system. The scope system comprises a processor 402 functionally coupled to a POA adjustment system 406 and an adjustment controller 408. In one embodiment, the adjustment controller 408 may optionally control the POA adjustment system 406 (as indicated by a dashed line 410) directly in a manner similar to that described above in reference to FIGS. 1-12.

The scope system further comprises a ballistic parameter input 404 that inputs one or more parameters to the processor 402. Such ballistic parameters may include, but are not limited by, target range, wind velocity, ammunition type, or rifle's shooting angle. The processor 402 determines a POA adjustment based on the input of the ballistic parameter(s). Some possible methods of determining the POA adjustment are described below in greater detail.

In general, it will be appreciated that the processors comprise, by way of example, computers, program logic, or other substrate configurations representing data and instructions, which operate as described herein. In other embodiments, the processors can comprise controller circuitry, processor circuitry, processors, general purpose single-chip or multi-chip microprocessors, digital signal processors, embedded microprocessors, microcontrollers and the like.

Furthermore, it will be appreciated that in one embodiment, the program logic may advantageously be implemented as one or more components. The components may advantageously be configured to execute on one or more processors. The components include, but are not limited to, software or hardware components, modules such as software modules, object-oriented software components, class components and task components, processes methods, functions, attributes, procedures, subroutines, segments of program code, drivers, firmware, microcode, circuitry, data, databases, data structures, tables, arrays, and variables.

Figure 14B:
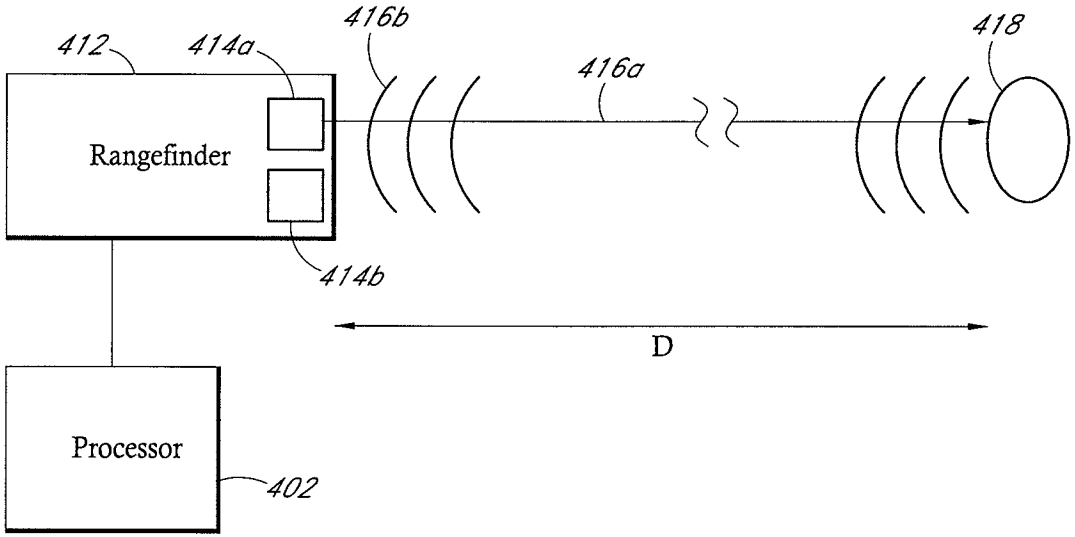
FIG. 14B illustrates simplified operating principles of a rangefinder that may be used in conjunction with the processor of FIG. 14A.
Figure 14C:
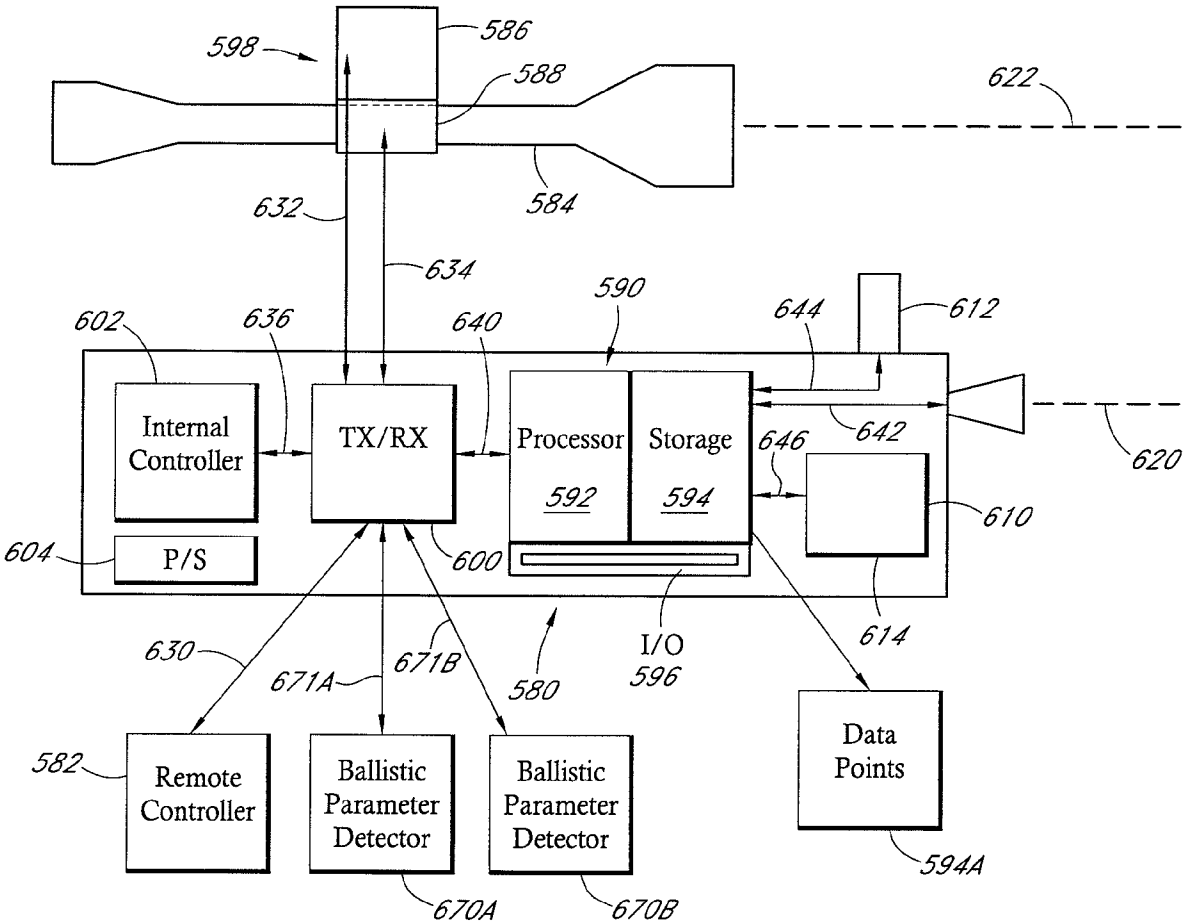
FIG. 14C illustrates a functional block diagram of one possible embodiment of the detached ballistic parameter determining component of FIG. 13B.

FIG. 14B illustrates a simplified operational principle of a rangefinder 412. The exemplary rangefinder 412 comprises a transmitter 414*a* that transmits a beam 416*a* of energy towards an object 418 whose range is being measured. The object 418 scatters the beam 416*a* into a scattered energy 416*b*, and some of the scattered energy 416*b* may return to the rangefinder 412 so as to be detected by a detector 414*b* therein. By knowing the time that elapsed between the transmission of the beam 414*a* and the receipt of the scattered energy 416*b*, and the speed of the energy beam in the medium (air, for example), the rangefinder 412 can determine the distance D between it and the object 418. Such range information can then be transferred to the processor 402 to be used for the scope adjustment.

FIG. 14C illustrates a functional block diagram of a ballistic parameter device 580 and its interaction with an adjustment system 598 mounted on a scope 584. The device 580 may be part of an integrated system described above in reference to FIG. 13A, a detached device of FIG. 13B, or any combination thereof.

The ballistic parameter device 580 is depicted as having exemplary ballistic parameter detectors such as a rangefinder 610, a wind velocity detector 612, and an inclinometer 614. It will be understood that these detectors are exemplary only, and in no way intended to limit the scope of the present teachings. A ballistic parameter device may have one or more of the aforementioned devices, one or more other ballistic parameter detecting devices not described above, or any combination thereof.

The exemplary rangefinder 610 may be configured to determine the range along a ranging axis 620. Preferably, the ranging axis 620 has a known orientation relative to an optical axis 622 of the scope 584.

The exemplary wind velocity and direction detector 612 may comprise a mechanically driven operating system (for example, a windmill-type device or a deflection device that responds to both the velocity and direction of the wind relative to the flight path and direction of the bullet), an electrical-based system (such as a pressure differential device), or any combination thereof. In certain embodiments, such wind velocity and direction detector system may be configured to respond to both wind velocity and wind direction along the lateral direction with respect to the optical axis 622.

The exemplary inclinometer 614 may comprise a commercially available device configured for use as described herein. Alternatively, the inclinometer may simply comprise means for inputting the rifle's shooting angle, determined either by an independent device or by an estimate.

In addition, the ballistic parameter device may receive ballistic parameters from one or more other ballistic parameter detectors 670A and 670B. Though only two other ballistic parameter detectors are illustrated, the system may include any number of ballistic parameter detectors. Ballistic parameter detectors 670A and 670B may sense one or more of temperature, altitude, air pressure, humidity, and wind velocity and wind direction, in a manner known in the art. The ballistic parameter device 580 is further depicted as having an exemplary transmitting and receiving (TX/RX) device 600. The ballistic parameter detectors 670A and 670B may provide detected ballistic parameters to the ballistic parameter device 580 via the TX/RX device 600 using links 671A and 671B, which may be wired or wireless links. In some embodiments, ballistic parameter detectors 670A and 670B may be integrated into the ballistic parameter device 580 or the scope 584.

The ballistic parameter device 580 is further depicted as having an exemplary computing device 590. The computing device 590 is depicted as including a processor 592, a storage 594, and an input/output (I/O) device 596. The computing device 590 is shown to receive ballistic parameters from the rangefinder 610 (via line 642), wind velocity and wind direction detector 612 (via line 644), and the inclinometer 614 (via line 646). The ballistic parameter input(s) from such exemplary detectors may be processed by the processor 592 to determine the POA adjustment as described herein. The storage 594 may be configured to store a variety of information associated with, for example, the ballistic parameter determination and the POA adjustment determination. The storage 594 may store a record 594A of a plurality of data points. Each data point may indicate a position of a POA indicator or a POA indicator adjustment and one or more ballistic parameters associated with the POA, such that the POA substantially coincides with the POI when a bullet is fired subject to the one or more ballistic parameters while the POA indicator indicates the POA.

The I/O device 596 may allow a user to either input information into the computing device 590, or output information from the computing device 590. Such device may comprise a drive adapted to receive a memory storage device such as a magnetic disk device, scan disk (SD) card, micro SD card, flash drive stick, blue tooth or a memory card. Alternatively, the I/O device may comprise a port adapted to allow the computing device to communicate with an external computer, for example via wireless link, blue tooth, or cable. One possible use of the I/O comprises transferring of a ballistic table for a given ammunition type from the external computer. The use of ballistic tables is described below in greater detail.

The TX/RX device 600 may receive a signal representative of a POA adjustment determined and sent (via line 640) by the computing device 590. The device 600 may then transmit the adjustment signal to the adjustment system 598. The adjustment system 598 is depicted as comprising an exemplary elevation adjustment mechanism 586 and an exemplary windage adjustment mechanism 588. Line 632 denotes a link (wire-based or wireless) between the TX/RX device 600 and the elevation adjustment mechanism 586, and line 634 denotes a link between the device 600 and the windage adjustment mechanism 588. It will be appreciated that the adjustment system 598 may comprise either of the elevation 586 or the windage adjustment mechanism 588 alone, or together as shown, without departing from the spirit of the present teachings.

The ballistic parameter device 580 is further depicted as having an exemplary built-in control unit 602. Such unit may be configured to allow a user to manually send a POA adjustment signal to the adjustment system 598, via the TX/RX device 600 (as shown by line 636). The built-in control unit 602 may also be configured to allow the user to manipulate the various functions of the ballistic parameter device 580.

Alternatively, the functionality of the built-in control unit 602 may be replaced, supplemented, or duplicated by a remote controller 582. The remote controller 582 may be similar to the other controllers described herein (for example, 570 in FIG. 13B), and may be configured to be linked to the TX/RX device 600 of the ballistic parameter device 580 (as shown by line 630, either wire-based or wireless). The remote controller 582 may be configured to allow manual control of the adjustment system 598 via the TX/RX device 600. The remote controller 582 may also be configured to allow the user to manipulate the various functions of the ballistic parameter device 580.

The ballistic parameter device 580 is further depicted as having an exemplary power supply 604. In certain embodiments, the power supply 604 comprises a battery (or batteries) which may have recharging capabilities. Such recharging capabilities may be utilized by plugging a commercially available ac/dc transformer power adapter "plug" into a receptacle of the power supply 604.

FIG. 14D illustrates one embodiment of a record 594A of a plurality of empirical data points 696A-D, including a position of a POA indicator and associated ballistic parameters that may be stored in the storage 594. It will be appreciated that the record may store any number of data points, and the four data points 696A-D shown are presented for purposes of illustration rather than limitation. Though a table is shown in FIG. 14D, the empirical data points 696A-D may be stored in any format known in the art, including trees and relational databases. The illustrated record illustrates the position of the POA indicator by an X offset 694A and a Y offset 694B, though other embodiments may indicate the position with other formats known in the art. The data points 696A-D also include one or more ballistic parameters associated with the position of the POA indicator, including, for example, range data 694C, wind data 694D, bullet data 694E, atmosphere data 694F, slope data 694G, and altitude data 694H. Wind data may indicate wind speed and direction along one or more axes relative to the firearm, such as the x axis, y axis, and z axis. Bullet data may indicate the weight, size, frictional coefficient, powder load, and any other dimension or property of a bullet. Atmosphere data may indicate any information about the atmosphere, including humidity, temperature, and air pressure.

The processor 592 may access the stored empirical data points 696A-D in the record 594A to determine a POA adjustment for new sensed ballistic parameters received from one of more of ballistic parameter detectors 670A and 670B, rangefinder 610, wind velocity detector 612, and/or the inclinometer 614. The processor may first determine if the ballistic parameters corresponding to the stored data points 696A-D are substantially identical to the new sensed parameters. For example, if a new sensed parameter is a range of 250 meters, the processor may access the record 594A to determine if any data point 696A-D corresponds to a substantially identical range. The processor may then determine that data point 696D has a range that is substantially identical with the new sensed parameter, and may then use part or all of the corresponding POA adjustment information to determine a POA indicator adjustment. For example, the processor may use the Y offset of −0.5 MOA as the POA adjustment in response to receiving the new sensed parameter of the range of 250 meters.

The processor may also interpolate the POA adjustment from the data points 696A-D. For example, if the processor receives new sensed parameters including a range of 296 meters and a 7 mph crosswind on the x-axis, the processor may determine that no data point 696A-D has ballistic parameters that are substantially identical to the new sensed parameters. The processor may then use some of all of the data points 696A-D to interpolate the POA adjustment information for the new sensed parameters. The processor may interpolate the data by developing a ballistic equation for one or more of the ballistic parameters that models the affect of the one or more ballistic parameters on the trajectory of a projectile, for example a ballistic curve (described below). It will be appreciated that a greater number of empirical data points increases the accuracy of the POA adjustment, both by increasing the likelihood that new sensed parameters will be identical to stored parameters and by increasing the accuracy of the interpolation. The processor may use a combination of using adjustment information from data points that have parameters that are substantially identical to new sensed parameters and interpolation of other parameters. For example, the processor may determine a Y adjustment by determining a data point has a substantially identical range and then using the corresponding Y offset information and may determine an X adjustment by interpolating wind information from a plurality of data points.

Figure 15A:
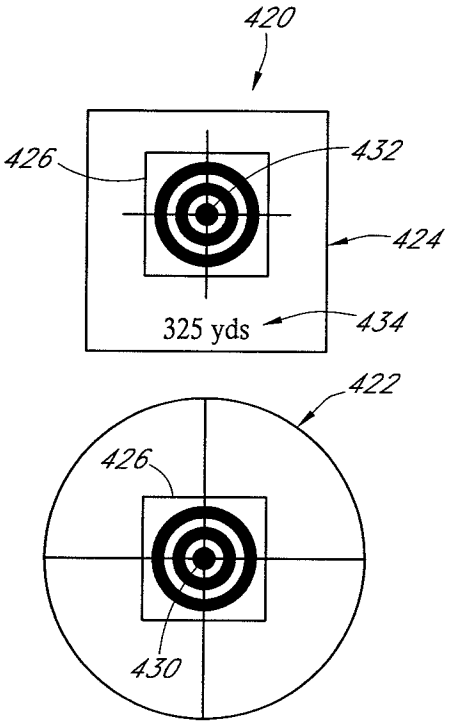
FIGS. 15A-C illustrate how various ballistic parameters such as target range and wind velocity can be determined.
Figure 15B:
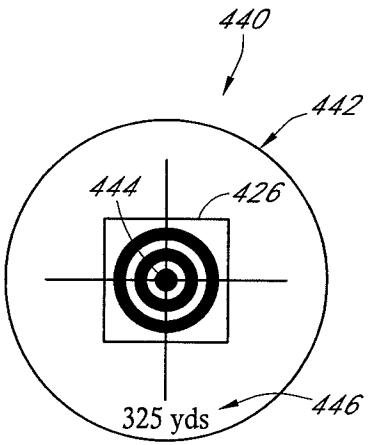
Figure 15C:
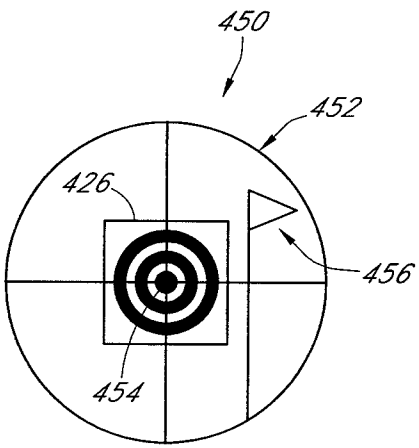

FIGS. 15A-C depict some possible configurations of the scope system for integrating the ballistic parameter into the processor. FIG. 15A illustrates one embodiment 420 having a separate scope sight picture 422 and a rangefinder picture 424. Preferably, the scope's POA 430 and the rangefinder's POA 432 generally point to a similar area on a target 426. The rangefinder determines a range 434, and provides the range information to the processor.

In another embodiment 440 shown in FIG. 15B, a rangefinder is integrated into a scope such that a POA 442 of the sight picture 442 indicates the ranging point on a target 426. A range 446 thus obtained is provided to the processor.

In yet another embodiment 450 shown in FIG. 15C, wind velocity and wind direction information may be input into the processor. The wind velocity and wind direction data information may be automatically transmitted to the processor from a built-in wind detector or via wireless link from an independent electronic wind detector set-up in a remote location. In both cases the wind data is transmitted to the processor so that the processor can then determine the amount of adjustment to the windage mechanism such that the POA will coincide with the calculated POI. The wind velocity and direction information may also be approximated by the shooter and entered into the processor. Such approximation may be facilitated by some form of a wind indicator such as a flag 456 or an independent commercially available hand held device that determines wind velocity and direction which information can then be manually inputted into the processor. If such equipment is not available in the shooting environment, the shooter may rely on natural feature's (such as grass) response to the wind to approximate the wind velocity. Although the wind indicator 456 is depicted to be proximate a POA 454 on the target 426, windage does not necessarily have to be determined at the target location. In many shooting situations, experience shooters can gauge the wind velocity between the rifle and the target using means such as flags and/or natural features.

It will be appreciated that any number of ballistic parameters may be passed onto the processor in any number of ways without departing from the spirit of the present teachings. For example, the load information about the ammunition may be entered into the processor by the shooter in any number of ways.

Figure 16:
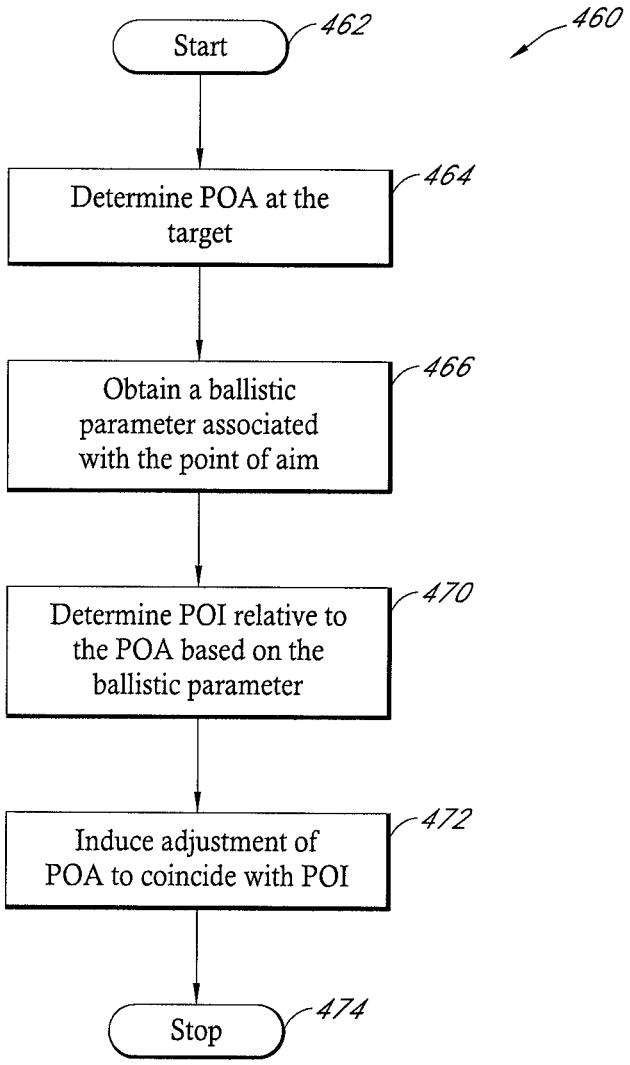
FIG. 16 illustrates one possible process for automatically adjusting the point of aim relative to the point of impact, based on the input ballistic parameter.

FIG. 16 illustrates a process 460 for adjusting the POA based on a ballistic parameter. The process 460 may be performed by the processor 402 in FIG. 14A. The process 460 begins at a start state 462, and in state 464 that follows, the process 460 determines the POA at the target. In state 466 that follows, the process 460 obtains a ballistic parameter associated with the point of aim. Such parameter may depend on the bullet's properties and/or the shooting environment (example; distance to target, slope to target, wind velocity and direction, temperature, altitude, air pressure and humidity). In state 470 that follows, the process 460 determines the POI relative to the POA based on the ballistic parameter. In state 472, the process 460 induces adjustment of the POA to coincide with the POI. The process 460 ends at a stop state 474.

To make the relative POA-POI displacement reduce to an acceptable value (referred to as "coincide" above) by the process 460, the rifle needs to be sufficiently stable, at least until the POI is determined. Otherwise, a shifting POA does not provide an accurate reference point for determination of the POI. In one embodiment, the processor may make the POI determination and "freeze" the relative POA-POI positions. Thus, fast processing of POI determination (relative to time scale associated with rifle pointing instability) may allow accurate POI determination even with a physically unstable aiming platform. In such an embodiment, the subsequent instability of the rifle during the POA adjustment generally does not affect the POI accuracy.

In another embodiment, the processor may continuously update the relative POA-POI positions and adjust the POA accordingly. It will be appreciated that the various adjustment mechanisms described above, in conjunction with the POI determination process, facilitate fast adjustment of the POA so as to reduce the effects of the rifle instability. Such an embodiment of the scope system is particularly useful in situations where the rifle is moving and/or the ballistic parameter is changing during acquisition of the target (for example, a moving target).

Figure 17A:
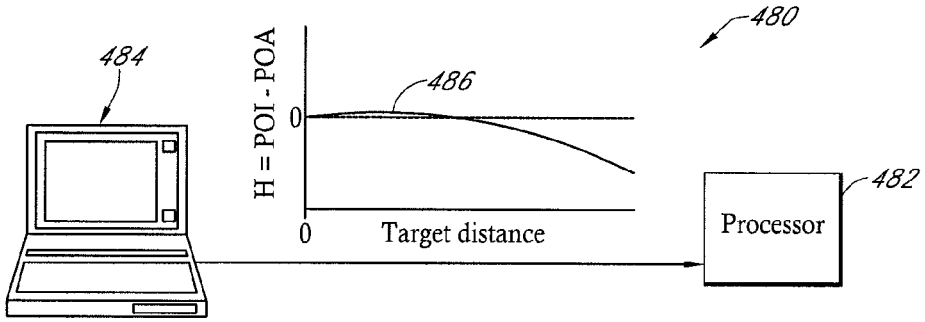
FIG. 17A illustrates one possible way of providing information to the processor to allow it to determine the point of impact relative to the point of aim for a given exemplary ballistic parameter, the target range, wherein the information is transferred from an external computer to the processor.
Figure 17B:
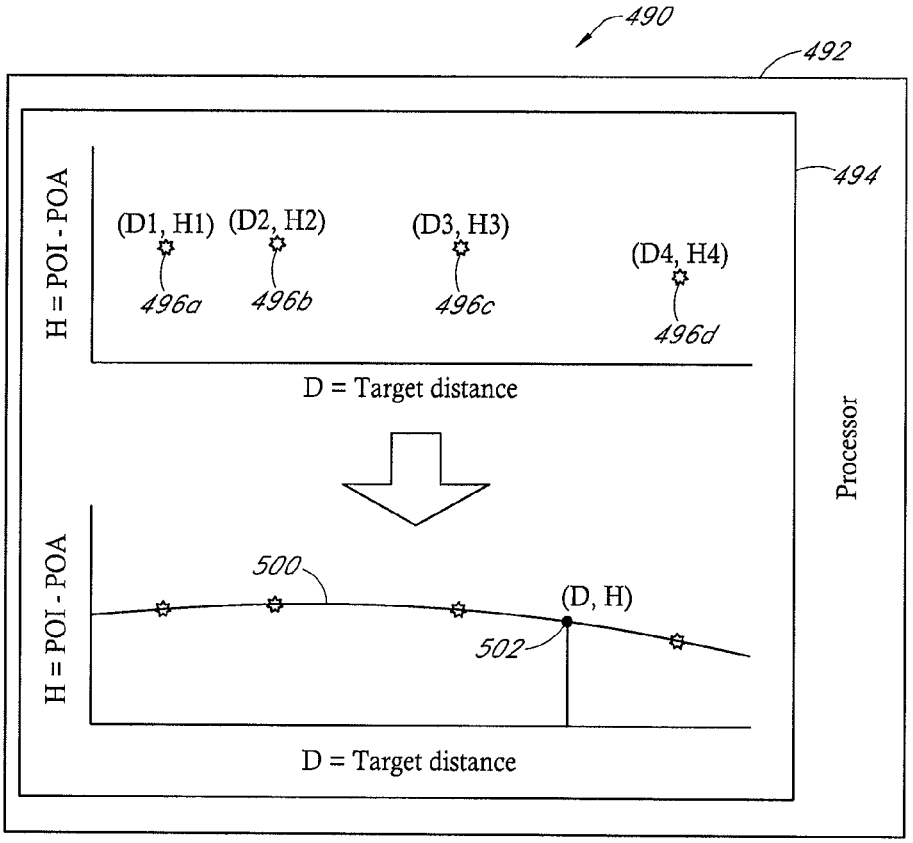
FIG. 17B illustrates one possible way of calibrating the processor to allow self-contained determination of the point of impact relative to the point of aim for a given exemplary ballistic parameter, the target range, wherein the calibration comprises making a plurality of shots at various target distances and measuring each points of impact with respect to some reference elevation, and wherein for subsequent shots at a given target distance, the corresponding elevation can be approximated based on the measured calibration shots.

FIGS. 17A-B now illustrate some possible exemplary methods of determining the POI relative to the POA based on the ballistic parameter (step 470 in process 460 of FIG. 16). Such methods may configure the processor prior to the adjustment process 460. The exemplary methods of FIGS. 17A-B are described in context of bullet's elevation trajectory. Thus, the target distance is the ballistic parameter for the purpose of the description. The target distance may be obtained from a rangefinder in a manner described above. It should be understood, however, that any other ballistic parameters (e.g., wind velocity, load type, etc.) may be treated in a similar manner without departing from the spirit of the present teachings.

FIG. 17A illustrates one exemplary method 480 where a bullet trajectory curve 486 is transferred from an external computer 484 to a processor 482 of the scope system. The curve 486 may be in the form of a look-up table, or an algorithm that calculates the displacement H=POI−POA from the target distance using some known algorithm. Many commercially available software products can provide such functions (or something similar). A given curve may depend on the properties of the ammunition, such as, by way of example, bullet weight, bullet's ballistic coefficient, caliber, amount of propellant powder, and muzzle velocity. Once transferred onto the processor 482 and in step 470 of the process 460, the target range determined by the rangefinder and input to the process 460 (step 466) can be used to determine the corresponding value of H.

FIG. 17B illustrates another exemplary method 490 of determining the POI relative to the POA based on one or more ballistic parameters. Though target distance will be used as an example in the following description, the method applies to any other ballistic parameter as well. The processor obtains a plurality of data points representing target distances and their corresponding values of H=POI−POA. Each data point (i-th data point) can be obtained by making a shot, observing the difference in height between $POA_i$ and $POI_i$, moving the $POA_i$ to the $POI_i$ (by $H_i$), and having the processor record the value of $H_i$. When the $POA_i$ is set to the $POI_i$, the zero crossing point of a bullet fired from the firearm is at distance $D_i$. The zero crossing point is the point at which the path of a projectile intersects the horizontal sighting plane of the optical assembly. For example, the data point associated with the range of D1 indicates the POA must be adjusted by H1 so that a projectile fired by the firearm will cross the horizontal sighting plane when it is at distance equal to D1 from the firearm. Other than the recording part, such a process is similar to the POA adjustment method described above in reference to FIGS. 12A-B. A method of storing data points will be described in further detail below.

In FIG. 17B, four such exemplary data points 496*a-d* are shown. The processor may interpolate the data to determine a POA adjustment H such that the POI at distance D coincides with the POA. In one embodiment, the interpolation comprises obtaining a curve 500 based on the data points 496*a-d*, wherein the curve 500 allows approximation of value of H given a target distance D (at an exemplary point 502). Such a curve can be obtained in any number of ways. For example, if the trajectory is relatively "flat," or if the shooter obtains sufficient number of calibration data shot points, simple joining of the neighboring data points may provide sufficient accuracy in H for a given D.

Alternatively, a curve can be fit based on the data points. As is generally understood, the trajectory of a projectile under gravitational influence typically has a parabolic shape that can be characterized as $$y=a+bx+cx^2. \quad (2)$$

where x and y respectively represent horizontal and vertical positions of the projectile, and a, b, and c are constants for a given load being calibrated and used. The constant a is usually taken to be approximately zero if the rifle's barrel is considered to be at the reference zero elevation. Given the exemplary data points 496*a-d*, the processor may be configured to fit Equation (2) to obtain the values of the constants b and c. Such determined values of a, b, and c may be stored in a memory location on the processor or some other location accessible by the processor. Subsequent determination of y based on input values of x may be performed in any number of ways, including but not limited to, formation of lookup tables or an algorithm programmed into the processor.

Once such fit parameters of Equation (2) are obtained and stored, the shooter can acquire a target, from which a rangefinder determines the distance D. The processor may then automatically input the value of D as x in Equation (2), and determines (calculates) the corresponding value of y (H). The POA is then automatically adjusted based on the value of H in a manner similar to that described above. These automatic vertical and windage adjustments to the POA are performed in a manner wherein the marksman simply has to look through the scope at the target and place the POA on the target. The range finder automatically determines the distance to the target and then transmits such yardage data to the processor which in turn calculates the total amount of vertical and windage adjustments necessary to move the reticle from the POA to the anticipated POI. These automatic adjustments are made in response to and in combination with the other current environmental conditions. Such environmental conditions may include slope angle, wind velocity, wind speed, temperature etc. Thus, no matter what the distance or environmental condition the marksman is faced with in the field or at the range; the marksman only has to concentrate on holding the POA on the target and pulling the trigger. The adjustments made to the vertical and windage mechanisms via the internal controller are automatically made via the data provided to the controller by the processor. The data information provided by the processor to the internal controller may be automatically and instantaneously retrieved from one or more of the data storage areas in response to the environmental conditions at hand. These pieces of previously recorded and stored data are then processed in such a way as to accurately predict the exact incremental adjustment necessary in moving the POA to the anticipated POI. It will be appreciated that the elevation/distance calibration method described above in reference to FIG. 17B does not require knowledge of the bullet's ballistic properties because the data points associated with the trajectory are determined empirically.

As previously described, the scope system may be configured to integrate and utilize other (than elevation) ballistic parameters without departing from the spirit of the present teachings.

Figure 18:
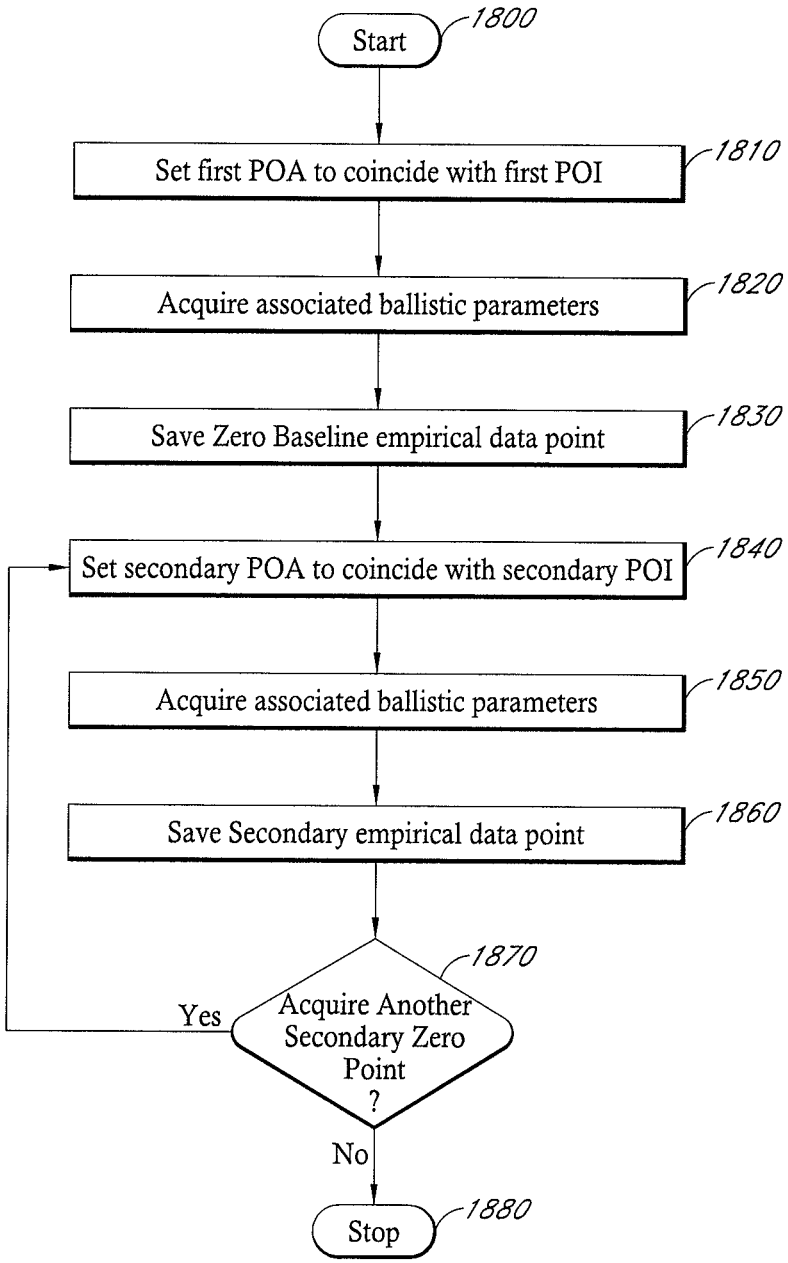
FIG. 18 illustrates one embodiment of a method of acquiring data points representative of a position of a POA indicator and one or more associated ballistic parameters.

FIG. 18 illustrates one embodiment of a method of acquiring data points representative of a position of a POA indicator and one or more associated ballistic parameters. The method begins in block 1800 and proceeds to block 1810, where after a shot is fired the POA indicator is set in a first position so that a first POA coincides with a first POI. Next, in block 1820, one or more associated ballistic parameters are acquired. Associated ballistic parameters are ballistic parameters sensed substantially contemporaneously with the firing of a shot, such that the parameters indicate the parameters that the projectile was subject to during its flight. The ballistic parameters may be received from various devices that are configured to sense ballistic parameters. In block 1830, the position of the POA indicator, which may be indicated by an absolute position (e.g., coordinates) or a relative position (e.g., an MOA adjustment from a reference point), and associated ballistic parameters are saved to create a zero baseline data point. In one embodiment, the zero baseline data point creates a point of reference from which other POA indicator adjustments are determined.

Moving to block 1840, after a second shot is fired a secondary position of the POA indicator is set so the POA coincides with the POI of the second shot. In block 1850 ballistic parameters associated with the second shot are acquired, and in block 1860, the secondary position of the POA indicator and the associated ballistic parameters are saved. The secondary position of the POA indicator may be indicated as an adjustment relative to the position of the POA indicator associated with the zero baseline data point. For example, the secondary position of the POA indicator may indicate a number of MOA increments relative to the position of the POA indicator of the zero baseline data point. This may allow all the data points to be recalibrated by setting a new zero baseline data point. In block 1870, it is determined if another secondary data point is to be acquired. If not, the method proceeds to block 1880, where it stops. Otherwise, the method returns to block 1840 and another secondary data point is acquired and saved. Any number of data points may be acquired and saved. As more data points are saved, a massive record of data points may be created with the information from hundreds or thousands of shots. The data points may contain empirical data that indicates the POA position for many different ranges, wind velocities, atmospheric conditions, projectile dimensions, altitudes, slopes, etc. As the number of data points increases, the accuracy of POA adjustment improves because it is more likely that there is a data point with ballistic parameters substantially identical to currently sensed ballistic parameters, and because the greater number of data points may increase the accuracy of interpolation performed by the processor by providing the processor more detailed information about the affect of ballistic parameters on the trajectory of a projectile.

Figure 19:
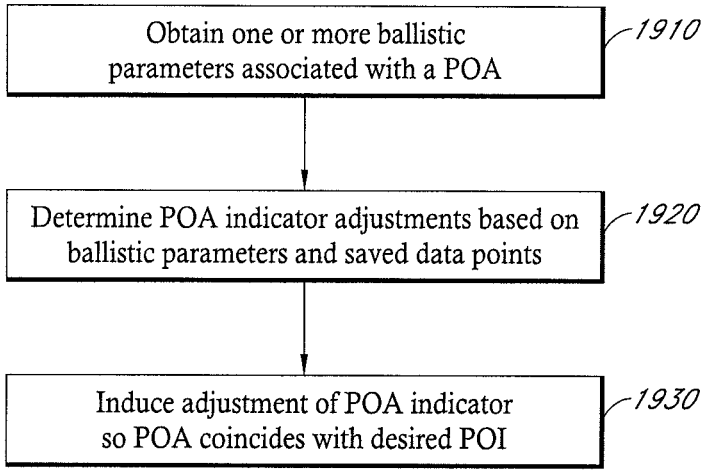
FIG. 19 illustrates one embodiment of a method of adjusting the position of a POA indicator of an optical assembly.

FIG. 19 illustrates one embodiment of a method of adjusting the position of a POA indicator of an optical assembly. In block 1910, one or more ballistic parameters associated with a POA are obtained. Moving to block 1920, a processor determines one or more POA indicator adjustments based on the target ballistic parameters and the data points. In one embodiment, the processor determines that a data point saved in memory has ballistic parameters that are substantially identical to the target ballistic parameters. The processor may then adjust the position of the POA indicator to the position of the POA indicator associated with the data point. For example, if the target ballistic parameter is a range of 100 yards and a data point is associated with a range of 100 yards, the processor may then adjust the POA indicator to the position of the POA indicator associated with the data point. In other embodiments, the processor may determine a POA indicator adjustment by interpolating data from a subset of the data points or all of the data points. In block 1930, the processor induces the adjustment of the POA indicator so that the when the POA is indicated by the POA indicator the POA substantially corresponds with the POI. The inducement may be performed by sending a signal to an actuator mechanism that is coupled to the optical assembly.

The use of empirical data points advantageously allows for custom data points to be acquired for a firearm that indicate the actual performance of the firearm, and reduces or eliminates reliance on a generic ballistic table that only includes general information. The custom data points may account for parameters unique to each firearm, such as the distance between the scope and the firing plane and variations in the barrel, performance differences of the firearm in different conditions, wear of the firearm, and performances differences when using different ammunition. Also, increasing the number of data points may increase the accuracy of the interpolation of a POA indicator adjustment by providing the processor more data to use when calculating the POA indicator adjustment for a given set of ballistic parameters.

Figure 20A:
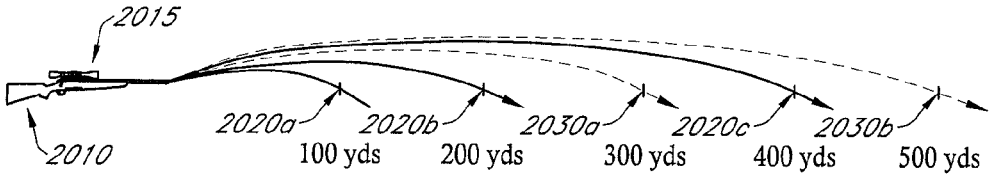
FIGS. 20A and 20B illustrate embodiments of a method of determining a POA adjustment.
Figure 20B:
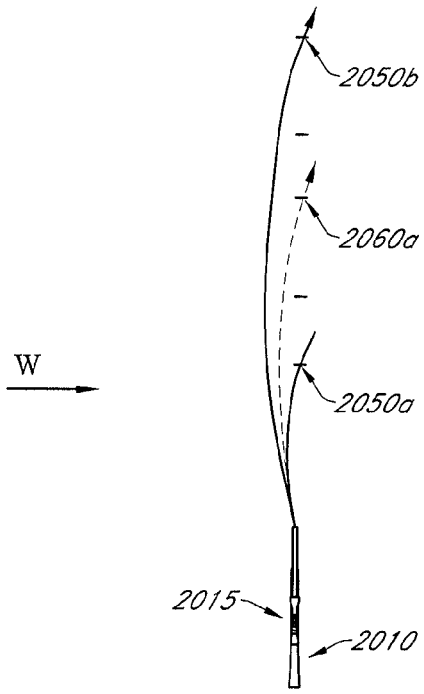

FIGS. 20A and 20B illustrate embodiments of a method of determining a POA adjustment. In FIG. 20A, a scope system 2015 of a firearm 2010 has saved data points 2020*a*, 2020*b*, and 2020*c*. Each data point indicates the range and a POA indicator position of the scope system 2015. For example a POA indicator may be a reticle, such as cross hairs, a dot, and/or a circle. When the POA indicator of the scope system 2015 is in the position indicated by a data point, the zero crossing of the horizontal plane of the POA indicator of a bullet fired from the firearm 2010 will coincide with the associated range indicated by the data point. When a new range is received for a target, a new range referring to at a range that does not correspond to a range associated with a saved data point, for example range 2030*a* or 2030*b*, the scope system 2015 will interpolate a position of the POA indicator from the saved data points 2020*a-c*. When the POA indicator is in the interpolated position, for example the position interpolated for range 2030*a*, a bullet fired from the firearm 2010 will cross the horizontal plane of the POA indicator at a range that substantially coincides with the new range 2030*a*.

FIG. 20B illustrates how the scope system may compensate for windage. In FIG. 20B, a scope system 2015 has saved data points 2050*a* and 2050*b* that indicate a respective range, wind velocity $W_{saved}$, and POA indicator position. When the POA indicator of the scope system 2015 is in the position indicated by a data point, the zero crossing of the vertical plane (and in some embodiments the horizontal plane as well) of a bullet fired from the firearm 2010 that is subject to the associated $W_{saved}$ will coincide with the associated range indicated by the data point. When a new range 2060*a* and a new wind velocity $W_{new}$ are received for a target, a position of the POA indicator may be interpolated such that the zero crossing of the vertical plane of the POA indicator (or both planes of the POA indicator, also referred to as the "line of sight" of the POA indicator) of a fired bullet will coincide with the new range. Any number of parameters associated with a target may be accounted for in the POA indicator adjustment and in the interpolation, such that a fired bullet will cross the line of sight of the scope at the position of the target.

Figure 21A:
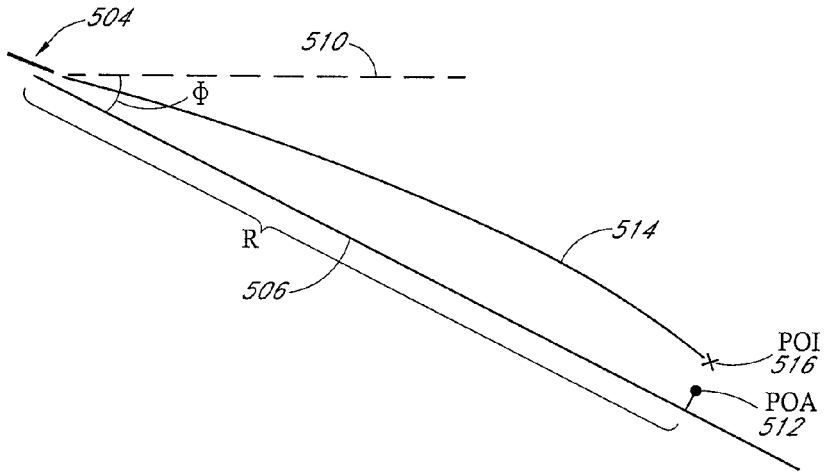
FIGS. 21A-B illustrate the bullet's trajectory in downhill and uphill shooting situations, showing how the point of impact is high if the point of aim is determined based on the target range alone.
Figure 21B:
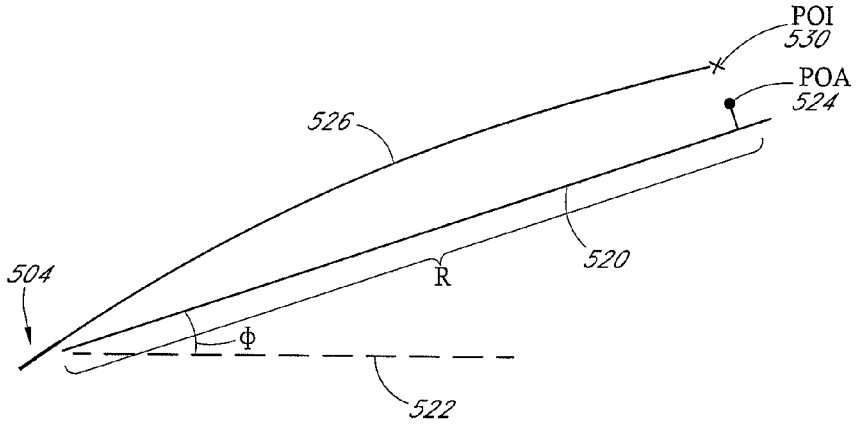

One aspect of the present teachings relates to integrating and utilizing a terrain-related ballistic parameter to adjust for the effect of shooting a rifle either downhill or uphill. FIGS. 21A and 21B illustrate exemplary downhill and uphill shooting situations. In FIG. 21A, a rifle 504 is aimed at a POA 512 of a target located at a range R along a downhill slope 506. The slope 506 forms an angle $\phi$ with respect to a horizon 510. As is understood in the art, when the rifle 504 is shot at the POA 512 (adjusted for range R, either in one of the methods described above, or otherwise), the bullet impacts at a POI 516 that is higher than the POA 512 with respect to the downhill slope 506 at the target.

Similarly in FIG. 21B, the rifle 504 is aimed at a POA 524 of a target located at a range R along an uphill slope 520. The slope 520 forms an angle $\phi$ with respect to a horizon 522. As is also understood in the art, when the rifle 504 is shot at the POA 524 (adjusted for range R, either in one of the methods described above, or otherwise), the bullet impacts at a POI 530 that is higher than the POA 524 with respect to the downhill slope 520 at the target.

Both of the "shooting high" effects illustrated in FIGS. 21A and 21B are due to the rifle-to-target line deviating from the horizon (by approximately $\phi$) that is generally perpendicular to the gravitational field. As is understood in the art, one common method of accounting for the angle $\phi$ to the target, thereby reducing the high POI, is to treat the range to target not as R, but as approximately $R \cos \phi$. The angle $\phi$ may be obtained in any number of ways, including but not limited to, some form of an inclinometer whose output is integrated into the scope system, an independent device whose reading is obtained by the shooter, or simply a shooter's visual approximation. The angle determined in the foregoing manner may be used by the scope system to adjust the POA.

Figure 22:
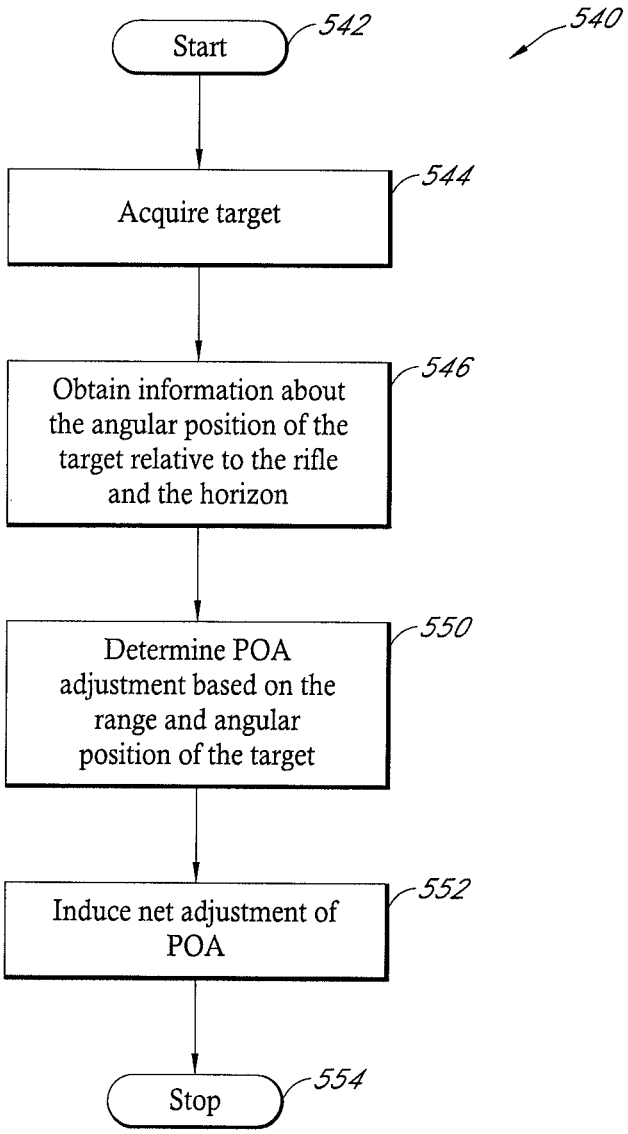
FIG. 22 illustrates one possible process for determining the point of aim adjustment based on the angle of the rifle with respect to the horizon.

FIG. 22 illustrates one such possible process 540 for adjusting the POA based on the angular position of the target with respect to the horizon and the rifle. The process 540 begins at a start state 542, and in state 544 that follows, the process 540 acquires the target in a manner similar to that described above. In state 546 that follows, the process 540 obtains information about the angular position of the target with respect to the horizon and the rifle. In state 550 that follows, the process 540 determines a POA adjustment based on the range and the angular position of the target. In state 552 that follows, the process 540 induces the POA adjustment. The process 540 ends in a stop state 556.

One exemplary shooting situation and resulting POA adjustments are as follows: If a hill is at an angle of 20 degrees with respect to the horizon, and the target is 300 yards away from the shooter, $\phi$=20 degrees and R=300 yards. To determine the POA adjustment, a range of R cos $\phi$=300 cos(20) =300×0.94=282 yards would be used instead of 300 yards.

Based on the foregoing description of the various embodiments of the scope adjustment system, it should be apparent that similar systems and methods can be adapted to be used in any optical sighting devices attached any projectile launching devices. The optical sight does not necessarily have to magnify the image of the target. As an example, some optical sights simply project an illuminated dot as a POA, and the shooter simply places the POA at the target. Such non-magnified or low-power magnified devices are sometimes used, for example, in handguns and bows where the POA adjustment principles generally remain valid.

In one embodiment, various embodiments of the remote controller and the corresponding adjustment mechanism described herein can be integrated, configured, or manufactured to allow remote or automatic adjustment of magnification and optical focus of the scope. Some scopes have variable magnification that can be adjusted by, for example, turning the eyepiece end of the scope. A movement mechanism can be configured to couple to such an adjustment mechanism, so that the remote controller can induce the movement that changes the magnification of the scope. FIG. 13A shows one embodiment of a scope that includes an auto-zoom and autofocus feature that is based upon the same principle of adjustment methods and mechanisms of the previously described scope adjustment mechanisms. As previously described, the use of empirical data points advantageously allows for custom data points to be acquired for a firearm. In this example, such data points can also be integrated into the scope's adjustment mechanism in such a way as to not only make accurate adjustments to the vertical and windage adjustment mechanisms, but they can also be used to make adjustments to the scope's magnification and optical focus features as well.

For example, a target located only 100 yards away may require the scope to have a different magnification and focus setting than a target located at say 400 yards. In one embodiment, the marksman can first adjust his optical zoom and focus parameters to the 100 yard target and then "record" and store these settings in his adjustment system 384. The marksman can then proceed to repeat the same adjustment and storage procedures for a target located at 400 yards. Once these new optical parameters are stored for the 400 yard setting, the adjustment system 384 may then be able to automatically make the optical adjustments to the field of view 388 so that the field of view is more easily decipherable. Such adjustments may be automatically performed in the field or at the range whenever the marksman were to aim at a target located at a distance of similar yardage parameters. This optical adjustment procedure can be programmed and controlled to adjust in-synch with the scope's stored ballistic parameters so that the vertical, windage, magnification and focus adjustments can all be made automatically and in combination with each other.

Figure 23:
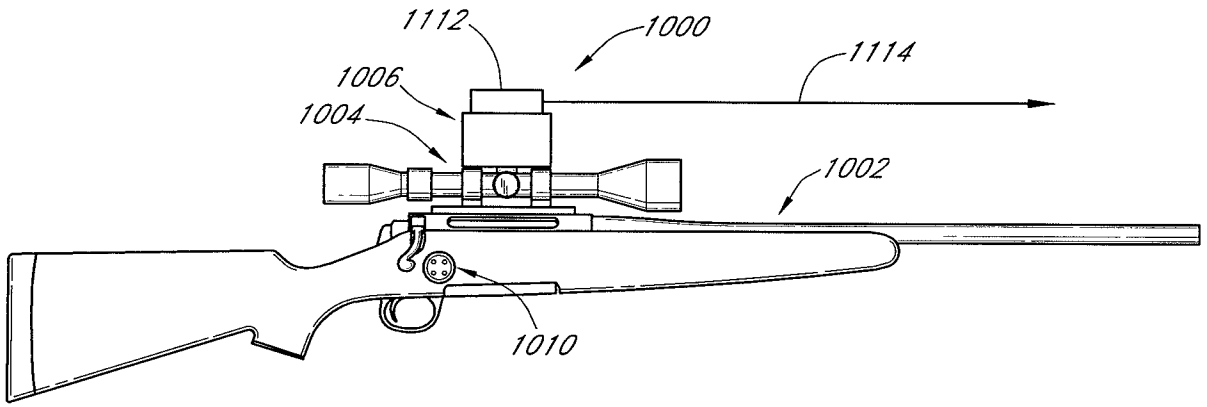
FIG. 23 illustrates one embodiment of a scope adjustment system mounted to an example firearm such as a rifle, where the scope adjustment system includes an adjustable light projection device such as a laser that can project a beam to a remotely located target.

FIG. 23 now shows one embodiment of a scope adjustment system 1000 that includes an adjustable light projection device 1112 that can project a beam 1114 to a target that is located remotely. In one embodiment, the light projection device 1112 is a laser, such that the beam 1114 is a laser beam. The laser can be a visible type (for example, HeNe laser), or other types such as an infrared laser (for which appropriate optical elements can be included so as to make the beam spot visible to the shooter).

In one embodiment as shown in FIG. 23, the light projection device 1112 is depicted as being mounted to an example adjustment mechanism 1006 which is in turn coupled to an example scope 1004. The scope 1004 is shown to be mounted to an example firearm such as a rifle 1002. In other embodiments, the light projection device 1112 can be mounted at other locations, such as but not limited to, the scope 1004 or the rifle 1002.

In one embodiment, the adjustment mechanism 1006 can be any of the various embodiments described above, or any other devices that provide similar functionalities. For example, as shown in FIG. 23, the adjustment mechanism 1006 can be controlled by a remote controller 1110 in a manner similar to that described above (for example, the remote controller 110 and the adjustment mechanism 106 of FIG. 1).

In one embodiment, the light projection device 1112 is adjustable so that the direction of the beam 1114 can be adjusted with respect to an optical axis of the scope 1004. Such adjustment can be achieved in a number of known ways, either manually or via some powered component(s). In one embodiment, the adjustment can be made so that the beam 1114 can move along directions having two orthogonal transverse components. In one embodiment, such adjustment of the beam 1114 can be achieved by a remote controller similar to the controller 1110. In one embodiment, the controller can be configured to toggle between adjustments of the scope 1004 and the light projection device 1112.

Figure 24A:
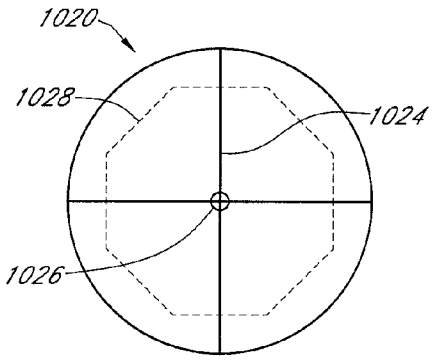
FIGS. 24A-D illustrate by example how the example laser beam can provide a visual reference indicator in the field of view of the target to facilitate the adjustment of the point of aim.

FIGS. 24A-24D now show an example sequence of how the light projection device 1112 and the adjust mechanism 1006 can be used in conjunction with the scope 1004. FIG. 24A shows one embodiment of a first example field of view 1020 through an example scope, where an example reticle 1024 (for example, a cross-hair) that defines a point-of-aim (POA) that is placed on a selected location on a target 1028. A beam spot 1026, projected from the light projection device 1112, is depicted as being positioned (by adjusting the light projection device 1112) so as to be at or near the POA. In this example sequence, a shot is made while the POA is positioned at the selected location on the target 1028. In other embodiments, the beam spot not actually be projected onto a target and may be a spot that is visible only in the scope.

Figure 24B:
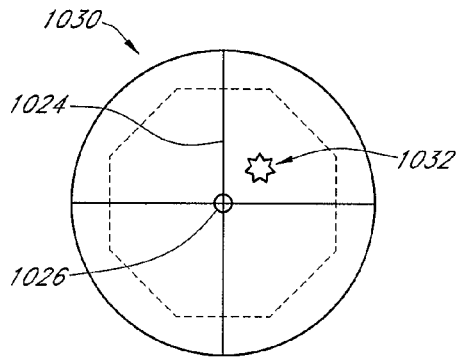

FIG. 24B shows a second example field of view 1030 depicting a point-of-impact (POI) 1032 of the projectile is different than the POA (reticle 1024). At this stage, the beam spot 1026 substantially coincides with the POA 1024 because the beam spot 1026 has not been adjusted from the first example field of view 1020. Based on the difference in the POA 1024 and the POI 1032, the reticle (POA) 1024 can be moved towards the POI 1032 in a manner described above. In one embodiment, the reticle 1024 can be moved substantially independently from the beam spot 1026, so that the beam spot 1026 remains at the pre-adjustment position of the FIGS. 24A and 24B while the reticle 1024 is moved towards the POI 1032. One can see that the beam spot 1026 can function as a reference marker at the target 1028 that indicates where the last POA had been as the reticle 1024 is moved.

The foregoing feature—where the beam spot 1026 provides a visual reference with respect to the reticle—can aid a shooter to re-establish a desired field of view after the first shot. For example, suppose that the shooter's attention is interrupted while the reticle 1024 is in the process of being moved. The shooter can re-establish the "original" field of view by positioning the beam spot 1026 at or near the original POA on the target 1028. Such positioning of the beam spot 1026 on the target can be facilitated by, for example, identifiable features on or about the target 1028 that the shooter can recall. A desired angular orientation of the field of view with respect to the target 1028 can be facilitated by the reticle 1024. Once the beam spot 1026 is positioned at or near the original POA, the reticle 1024 should be at or near the position (between the original POA and the POI 1032) before the shooter was interrupted. The shooter can then resume the movement of the reticle 1024 to the POI 1032 made by the first shot.

Figure 24C:
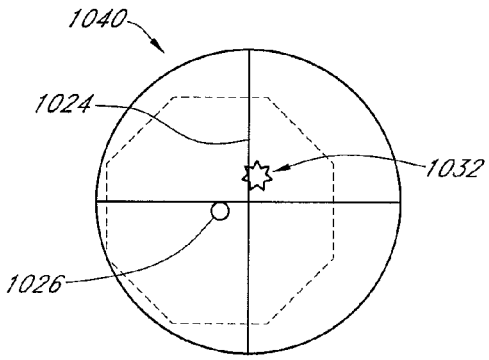
Figure 24D:
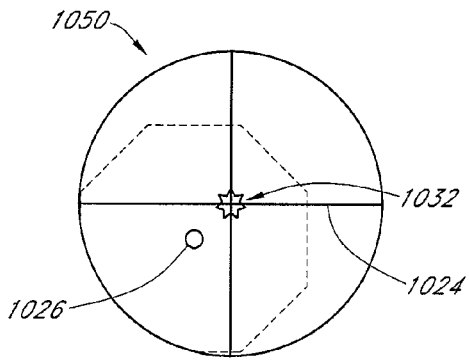

FIG. 24C shows a third example field of view 1040, where the reticle 1024 is being moved from the original POA (referenced by the beam spot 1026) to the POI 1032. FIG. 24D shows a fourth example field of view 1050, where the reticle 1024 has been move to the POI 1032, thereby establishing a new POA. The beam spot 1026 is shown to indicate the previous POA in the field of view 1050. If the shooter desires, the beam spot 1026 can be moved to the new POA, so as to provide a reference marker for the next adjustment (if necessary).

Some scope devices have a secondary visual indicator (such as a second reticle) in the scope itself. Use of such an indicator as a reference point on the target can depend on the shooter's viewing eye with respect to the scope. Use of a projected beam, however, provides a reference indicator at the target itself, and the reference beam spot at the target does not depend on the shooter's viewing angle. However, the use of a secondary visual indicator located within the scope itself can be used in place of or in conjunction with a projected beam of light without departing from the spirit of the present teachings. Such internal secondary visual indicators can be an illuminated dot, a traditional cross-hair or any other commercially available reticle design. Furthermore, the use of a light projection on a target may be illegal in some government territories when used in conjunction with hunting. In this situation, the option to use an internal secondary visual indicator would be preferable over a projected beam of light. Furthermore, a projected beam of light on a target may be hard to decipher when the target is in direct sunlight. In such cases, the use of a projected beam of light may be limited in distance during daylight hours. In this example, the use of an internal secondary indicator may be preferable to a projected beam of light.

Figure 25:
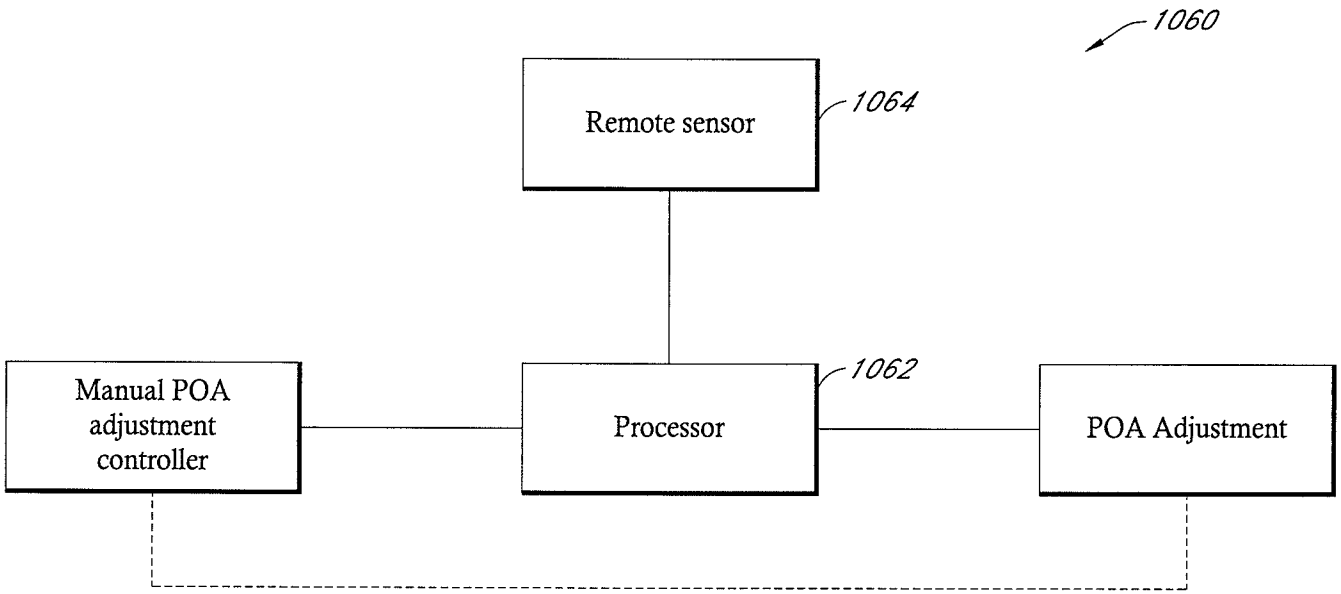
FIG. 25 illustrates one embodiment of a scope adjustment system that is configured to be able to obtain one or more ballistic parameters from a remote sensor so as to allow a processor to predict where the point of impact will be based on such one or more parameters.

FIG. 25 now shows one embodiment of a scope adjustment system 1060 that is configured to be able to obtain one or more ballistic parameters from a remote sensor. One or more ballistic parameter obtained in such a manner can be used to predict where the point of impact will likely be in a manner similar to those described above (for example, FIG. 14A).

In one embodiment as shown in FIG. 25, the scope adjustment system 1060 includes a processor 1062 that is configured to receive information from a remote sensor 1064. Such information can facilitate determination of one or more ballistic parameters at or near the location of the remote sensor 1064. Ballistic parameters can include, by way of examples, wind speed and direction, and the air properties such as relative humidity, barometric pressure, and temperature. Once such ballistic parameters are determined by the processor 1062, adjustment of the scope can be achieved in a manner similar to that described above in reference to FIG. 14A.

In one embodiment, the remote sensor 1064 transmits the ballistic information to the scope assembly in a wireless manner. In another embodiment, such transmission is achieved in a wire-based manner.

As one can appreciate, having one or more of the foregoing remote sensors 1064 positioned generally along the projectile's intended trajectory can provide accurate and relevant ballistic information. Usefulness of such information "from the field" can be appreciated in an example situation where the environmental condition about the shooter is significantly different than that along the substantial portion of the trajectory.

Figure 26:
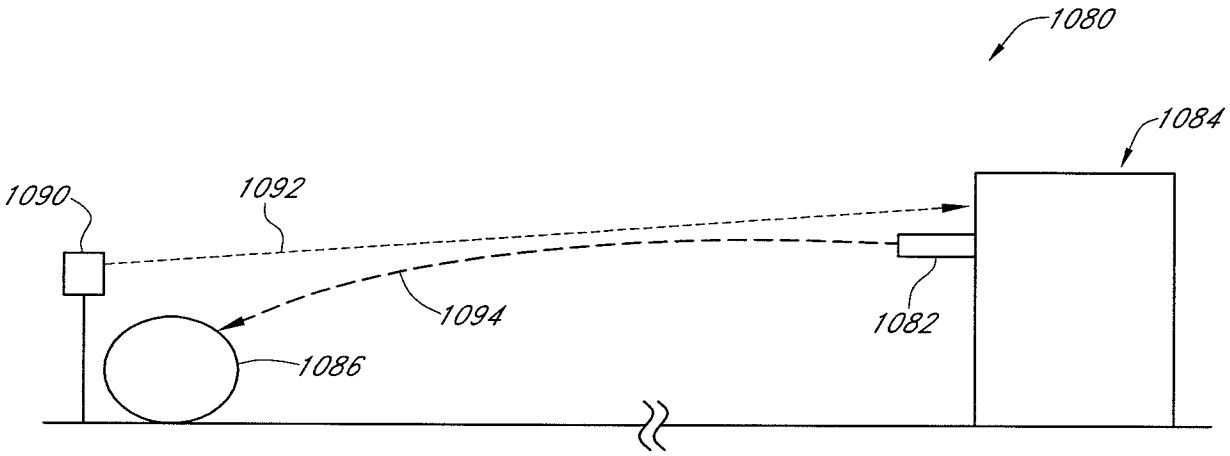
FIG. 26 illustrates one embodiment of the scope adjustment system being used in an example setting.

FIG. 26 shows one such example situation 1080 where one or more remote sensors 1090 can provide accurate field condition information for the purpose of trajectory estimation. A shooter (not shown) is depicted as being positioned in a partially enclosed structure 1084. Such structure can block the wind and also provide a warmer condition than that of outside. The shooter is depicted as shooting a rifle 1082 having scope adjustment system 1060 at a target 1086. If the shooter provides one or more ballistic parameters to the scope adjustment system 1060 based on the condition inside the enclosed structure 1084, the resulting trajectory estimate may be significantly different than what would result if the outside condition is used.

In one embodiment shown in FIG. 26, the scope adjustment system 1060 can include a remote sensor 1090 that is positioned at or near the target 1086. If the target 1086 is substantially stationary (such as in a target shooting situation), then such positioning of the remote sensor 1090 can be relatively easy, since the shooting direction and range are generally predetermined. If the target 1086 moves (such as in a hunting situation), one or more remote sensors 1090 can be placed along a likely direction and range of shooting.

As further shown in FIG. 26, the remote sensor 1090 is depicted as transmitting (line 1092) a signal to the scope adjustment configured rifle 1082. The signal 1092 can be processed in a manner described herein so as to make adjustments that yield a trajectory 1094 to the target 1086.

Although the above-disclosed embodiments of the present invention have shown, described, and pointed out the fundamental novel features of the invention as applied to the above-disclosed embodiments, it should be understood that various omissions, substitutions, and changes in the form of the detail of the devices, systems, and/or methods illustrated may be made by those skilled in the art without departing from the scope of the present invention. Consequently, the scope of the invention should not be limited to the foregoing description, but should be defined by the appended claims.

All publications and patent applications mentioned in this specification are indicative of the level of skill of those skilled in the art to which this invention pertains. All publications and patent applications are herein incorporated by reference to the same extent as if each individual publication or patent application was specifically and individually indicated to be incorporated by reference.

What is claimed is:

1. A sight system for a projectile weapon, the system comprising:

a ballistic parameter detector that measures one or more parameters that affect the ballistic flight of a projectile fired by the weapon;

an adjustable point of aim indicator device that defines a point of aim of the device, wherein the point of aim indicator is adjusted automatically so that the point of aim coincides with the point of impact for a projectile fired by the weapon for a given set of parameters measured by the ballistic parameter detector;

a memory wherein empirical point of aim adjustment data and correlated empirical ballistic parameters are stored, wherein the stored aim adjustment data and correlated ballistic parameters comprise data capture for successive firings of projectiles from the weapon; and a processor that, upon receiving new sensed ballistic parameters from the ballistic parameter detector, determines new point of aim indicator adjustment data based at least in part upon the stored empirical point of aim adjustment data and correlated empirical ballistic parameters and provides the new aim adjustment data to the adjustable point of aim indicator device to adjust the point of aim for the new sensed ballistic parameters.

2. The sight system of claim 1, wherein the new adjustment data comprises optical magnification data and focus data, and wherein the new point of aim indicator adjustment data is provided to the adjustable point of aim indicator device to further adjust a magnification and a focus of the adjustable point of aim indicator device and it's associated field of view.

3. The sight system of claim 1, wherein the processor determines the new point of aim indicator adjustment at least in part by interpolating the empirically stored point of aim adjustment data and the correlated empirical ballistic parameters.

4. The sight system of claim 3, wherein the processor further determines if the new sensed ballistic parameters are substantially identical to stored empirical ballistic parameters, and in response to determining that they are substantially identical, provides the stored point of aim indicator adjustment data correlated with the stored empirical ballistic parameters to the adjustable point of aim indicator device.

5. The sight system of claim 1, wherein the empirical point of aim adjustment data indicates X and Y coordinates of a position of a reticle of the adjustable point of aim indicator device, wherein the reticle indicates the point of aim.

6. The sight system of claim 1, wherein the adjustable point of aim indicator device comprises an actuator that adjusts the point of aim according to the new point of aim indicator adjustment data.

7. The sight system of claim 1, wherein ballistic parameters include range, wind velocity, humidity, altitude, slope, air pressure, temperature, altitude, projectile dimensions, and powder load.

8. The sight system of claim 1, wherein the new sensed ballistic parameters comprise a new range, wherein the processor determines the new point of aim indicator adjustment data based at least in part upon the stored empirical point of point of aim indicator adjustment data and correlated empirical range parameters and the new range, and wherein the new aim adjustment data comprises a Y axis adjustment of the point of aim such that the adjusted point of aim coincides with a point of impact of a projectile at the new range.

9. The sight system of claim 1, wherein the processor is located remotely from the adjustable aiming device.

10. The sight system of claim 9, wherein the processor provides the new point of aim indicator adjustment data to the adjustable point of aim indicator device via a wireless link.

11. The sight system of claim 10, wherein the ballistic parameter detector is located remotely from the adjustable aiming device and the processor.

12. The sight system of claim 11, wherein the processor receives the new sensed ballistic parameters from the ballistic parameter detector via a wireless link.

13. A sight system for a firearm, comprising:

an optical assembly having a point of aim indicator, wherein the point of aim indicator is configured to be movable relative to an optical axis of the optical assembly;

an adjustment mechanism coupled to the point of aim indicator and configured to adjust the point of aim indicator relative to the optical axis;

a ballistic parameter detector configured to detect one or more current ballistic parameters;

a memory; and a processor configured to initiate storage in the memory of an empirical zero data point indicating a first position of the point of aim indicator and one or more first ballistic parameters associated with the first position;

initiate storage in the memory of one or more empirical secondary data points, wherein each secondary data point indicates a secondary position of the point of aim indicator and one or more secondary ballistic parameters associated with the respective secondary position;

receive one or more current ballistic parameters associated with a target;

determine a point of aim adjustment increment between a current position of the point of aim indicator and an adjusted position of the point of aim indicator based on the zero data point, the one or more secondary data points, and the one or more current ballistic parameters; and signal the adjustment mechanism to adjust the position of the point of aim indicator according to the determined point of aim adjustment increment so that the point of aim indicator automatically coincides with the adjusted position.

14. The sight system of claim 13, wherein the adjustment mechanism is integrated with the point of aim indicator.

15. The sight system of claim 14, wherein in the secondary position the point of aim indicator indicates a point of aim that coincides with a point of impact of a projectile fired subject to the one or more secondary ballistic parameters.

16. The sight system of claim 15, wherein the adjusted point of aim indicator indicates a point of aim that coincides with a point of impact of a projectile fired subject to the one or more current ballistic parameters.

17. The sight system of claim 16, wherein the processor is configured to generate a table of data points, each data point indicating a position of the point of aim indicator and one or more associated ballistic parameters.

18. The sight system of claim 17, wherein if the processor determines the one or more current ballistic parameters are substantially identical to the one or more associated ballistic parameters of a data point, the processor determines that the adjusted position of the point of aim indicator is the position of the point of aim indicator associated with the data point.

19. The sight system of claim 18, wherein if the processor determines the one or more current ballistic parameters are not substantially identical to the one or more associated ballistic parameters of a data point, the processor interpolates the adjusted position of the point of aim indicator from all the data points in the table of data points or a subset of the data points in the table of data points.

20. The sight system of claim 19, wherein the processor interpolates the adjusted position of the point of aim indicator by fitting the data points to a curve.

21. The sight system of claim 13, wherein in the first position the point of aim indicator indicates point of aim that coincides with a point of impact of a projectile fired subject to the one or more first ballistic parameters.

* * * * *

UNITED STATES PATENT AND TRADEMARK OFFICE

CERTIFICATE OF CORRECTION

PATENT NO. : 8,468,930 B1
APPLICATION NO. : 12/607822
DATED : June 25, 2013
INVENTOR(S) : John Curtis Bell It is certified that error appears in the above-identified patent and that said Letters Patent is hereby corrected as shown below:

In the Specification

In Column 18, Line 16, please change "598," to --598--.

In the Claims

In Column 29, Line 49 (Claim 7), after "temperature,", please delete "altitude".

In Column 29, Line 55 (Claim 8), after "point of", please delete "point of". (second occurrence)

Signed and Sealed this
Thirty-first Day of December, 2013

Margaret A. Focarino

Margaret A. Focarino
*Commissioner for Patents of the United States Patent and Trademark Office*